US008264424B2

(12) United States Patent
Hashimoto et al.

(10) Patent No.: US 8,264,424 B2
(45) Date of Patent: Sep. 11, 2012

(54) PLASMA DISPLAY MODULE AND ITS DRIVING METHOD, AND PLASMA DISPLAY

(75) Inventors: Yasunobu Hashimoto, Miyazaki (JP); Masaji Ishigaki, Miyazaki (JP); Masayuki Shibata, Miyazaki (JP); Tomokatsu Kishi, Miyazaki (JP)

(73) Assignee: Hitachi, Ltd., Tokyo (JP)

( * ) Notice: Subject to any disclaimer, the term of this patent is extended or adjusted under 35 U.S.C. 154(b) by 948 days.

(21) Appl. No.: 11/919,439

(22) PCT Filed: Jul. 6, 2005

(86) PCT No.: PCT/JP2005/012502

§ 371 (c)(1),
(2), (4) Date: Mar. 21, 2008

(87) PCT Pub. No.: WO2007/004305

PCT Pub. Date: Jan. 11, 2007

(65) Prior Publication Data

US 2008/0218447 A1 Sep. 11, 2008

(51) Int. Cl.
*H01J 13/56* (2006.01)

(52) U.S. Cl. ..... 345/63; 315/169.4

(58) Field of Classification Search ..... 345/60–72; 315/169.3, 169.4; 313/483–493
See application file for complete search history.

(56) References Cited

U.S. PATENT DOCUMENTS 6,337,674 B1 1/2002 Kim
2002/0180665 A1 * 12/2002 Awamoto et al. ..... 345/60
2003/0151566 A1 8/2003 Takeuchi et al.
2004/0051470 A1 3/2004 Hashimoto et al.
2005/0212725 A1 * 9/2005 Sasaki et al. ..... 345/63

FOREIGN PATENT DOCUMENTS

EP 1 336 951 A2 8/2003
EP 1 394 764 A 3/2004
(Continued)

OTHER PUBLICATIONS

International Preliminary Report on Patentability and Written Opinion of the International Searching Authority, issued in corresponding International Patent Application No. PCT/JP2005/012502, mailed on Oct. 25, 2005.
International Preliminary Report on Patentability and Written Opinion of the International Searching Authority, issued in corresponding International Patent Application No. PCT/JP2005/012502, mailed on Jan. 17, 2008.
International Search Report issued in corresponding International Patent Application No. PCT/JP2006/012502, dated Oct. 25, 2005.

*Primary Examiner* — Amr Awad
*Assistant Examiner* — Aaron Midkiff
(74) *Attorney, Agent, or Firm* — McDermott Will & Emery LLP

(57) ABSTRACT

Luminance of a plasma display is enhanced while suppressing deterioration in resolution. In a plasma display module comprising panel sections (12, 18) and a circuit section (27) and performing display by receiving an interlace signal, two horizontal lines adjacent vertically in each of odd field and even field form a set, two vertically adjacent cells belonging to a set of two horizontal lines display one pixel, each field consists of a plurality of subframes, and two cells in the set are lighted or unlighted simultaneously in a certain subframe at least for some display load rate wherein the ratio of emission intensity is different from 1 when the two cells are lighted simultaneously.

18 Claims, 25 Drawing Sheets

FOREIGN PATENT DOCUMENTS

| | | | |
|---|---|---|---|
| EP | 1 439 516 | A | 7/2004 |
| JP | 05-216433 | | 8/1993 |
| JP | 09-160525 | | 6/1997 |
| JP | 2001-067042 | | 3/2001 |
| JP | 2002-202750 | | 7/2002 |
| JP | 2003-233346 | | 8/2003 |
| JP | 2003-233346 | A | 8/2003 |
| JP | 2004-93811 | A | 3/2004 |
| JP | 2004-516513 | A | 6/2004 |
| WO | WO 02/50808 | A2 | 6/2002 |

* cited by examiner (a)

(b)

$$\frac{2+\alpha}{2(1+\alpha)}I(2n+1)+\frac{\alpha}{2(1+\alpha)}I(2n+3)$$

$$\frac{\alpha}{2(1+\alpha)}I(2n)+\frac{2+\alpha}{2(1+\alpha)}I(2n+2)$$

(a)

(b)

(a)

(b)

CONTROL METHOD OF FIFTH EMBODIMENT

PLASMA DISPLAY MODULE AND ITS DRIVING METHOD, AND PLASMA DISPLAY

RELATED APPLICATIONS

This application is the U.S. National Phase under 35 U.S.C. §371 of International Application No. PCT/JP2005/012502 filed on Jul. 6, 2005, the disclosure of which Application is incorporated by reference herein.

TECHNICAL FIELD

The present invention relates to a method for driving a plasma display panel.

BACKGROUND ART

There is a technique called a common electrode type plasma display panel in which electrodes of adjacent cells are shared in order to reduce the number of driving electrodes (see Patent Document 1). Hereinafter, this technique is referred to as the Alternate Lighting of Surfaces (ALIS) method. In the ALIS panel, display lines are separated into odd/even groups as shown in FIG. 3, and interlace driving is performed in which odd lines are lighted during an odd field period, and even lines are lighted during an even filed period. In the ALIS panel, the rib is straight, and electrical discharge spreads in a vertical direction. Therefore, while only odd lines are lighted, the electrical discharge spreads into the area of even lines also. Thus, the ALIS panel is characterized in that the luminance is high. However, it has a disadvantage that, because electrical discharge spreads in a vertical direction, the electrical discharge interferes in vertical-direction cells, and driving is difficult.

This electrical discharge interference can be eliminated by forming the rib in a box shape and providing boundaries in the vertical direction of cells. However, this causes a disadvantage that electrical discharge is prevented from spreading in a vertical direction and the luminance deteriorates.

In order to overcome this disadvantage of luminance deterioration, Patent Document 2 discloses a technique in which data of the same one line is displayed by adjacent vertical two lines, the combination of lines is changed between the odd field period and the even field period. For example, it is assumed that the upper line between two combined lines is an odd line in the odd field, and the upper line is an even line in the even field, as shown in FIG. 4. As another prior-art technique, there is a technique in which, only for a part of subframes, adjacent two cells are caused to emit light with the same light emission intensity, as in Patent Document 3.

Patent Document 1: Japanese Patent Laid-Open Publication No. 9-160525

Patent Document 2: Japanese Patent Laid-Open Publication No. 2003-233346

Patent Document 3: National Publication of International Patent Application No. 2004-516513

DISCLOSURE OF THE INVENTION

The technique of Patent Document 2 has the problem that the resolution in the vertical direction of an image deteriorates. When it is assumed that the vertical-direction coordinate on the screen is denoted by y, and data on a certain vertical-direction line is denoted by s(y), the average image g(y) of the odd field and the even field displayed when two lines are simultaneously lighted is expressed as follows:

[Formula 1]

$$g(y) = \frac{1}{2}\left(s\left(y + \frac{p}{2}\right) + s\left(y - \frac{p}{2}\right)\right) \tag{1}$$

where the vertical-direction pixel pitch is denoted by p. That is, an image displaced by the amount corresponding to the pixel pitch is displayed being overlapped with the original image. This brings about an effect of a lowpass filter. When the vertical-direction space frequency is denoted by f, the filter characteristic $h_2(f)$ is expressed as below:

[Formula 2]

$$h_2(f) = \cos(\pi p f) \tag{2}$$

The vertical-direction resolution is lowered by the amount corresponding to the lowpass filter. In the case of Patent Document 3 also, the problem of deterioration of resolution is similarly caused in the tone expressed only by subframes in which light is emitted by a pair of cells.

In the present invention, luminance is improved while deterioration of resolution is suppressed.

In the present invention, any of two cells combined as a pair is determined as a primary cell, in a subframe during which the two cells are lighted, and the light emission intensity of the other cell to be secondary is made lower than that of the cell to be primary so that balance is kept between light emission intensity and resolution.

Furthermore, paying attention to the difference between the resolution required by the display load rate and the effect obtained by two-line lighting, control dependent on the display load rate is performed to perform more detailed control.

In a current, common plasma display panel (PDP), the mechanism for the luminance being restricted differs depending on the display load rate. In the case of a load rate higher than a display load rate called an APC (automatic power control) point (generally, between 10% and 20%), luminance is controlled so that the power consumption of the panel is kept constant. Therefore, in such an area, the luminance of the panel is determined by the luminance per unit power consumption (effective efficacy). For simplification of description, it is assumed here that two cells combined as a pair have the same intensity. When two lines are simultaneously lighted, the luminance doubles, but the discharge power also doubles. The charge/discharge power of the panel capacity also increases though it does not double. Therefore, the effective efficacy does not increase much, and, at and above the APC point, luminance deterioration does not matter even if simultaneous two-line lighting is not performed.

On the other hand, in the areas below the APC point, luminance is controlled so that the sustain discharge frequency is kept constant. Consequently, if simultaneous two-line lighting is performed in such areas, the luminance doubles. Accordingly, in the present invention, mainly by increasing the light emission intensity of the cell to be secondary in the areas below the APC point to reduce occurrence of resolution deterioration, the panel luminance is improved.

That is, by adjusting the ratio of the light emission intensities of the primary and secondary cells by the display load rate, more detailed display control is performed.

According to the present invention, it is possible to perform image display having a good balance between resolution and luminance.

DESCRIPTION OF SYMBOLS

12, 13 display electrode
18 address electrode

BEST MODE FOR CARRYING OUT THE INVENTION

Best modes for carrying out the present invention will be described.

Embodiments of the plasma display module and the plasma display device of the present invention will be described with the use of drawings.

First Embodiment

Figure 1:
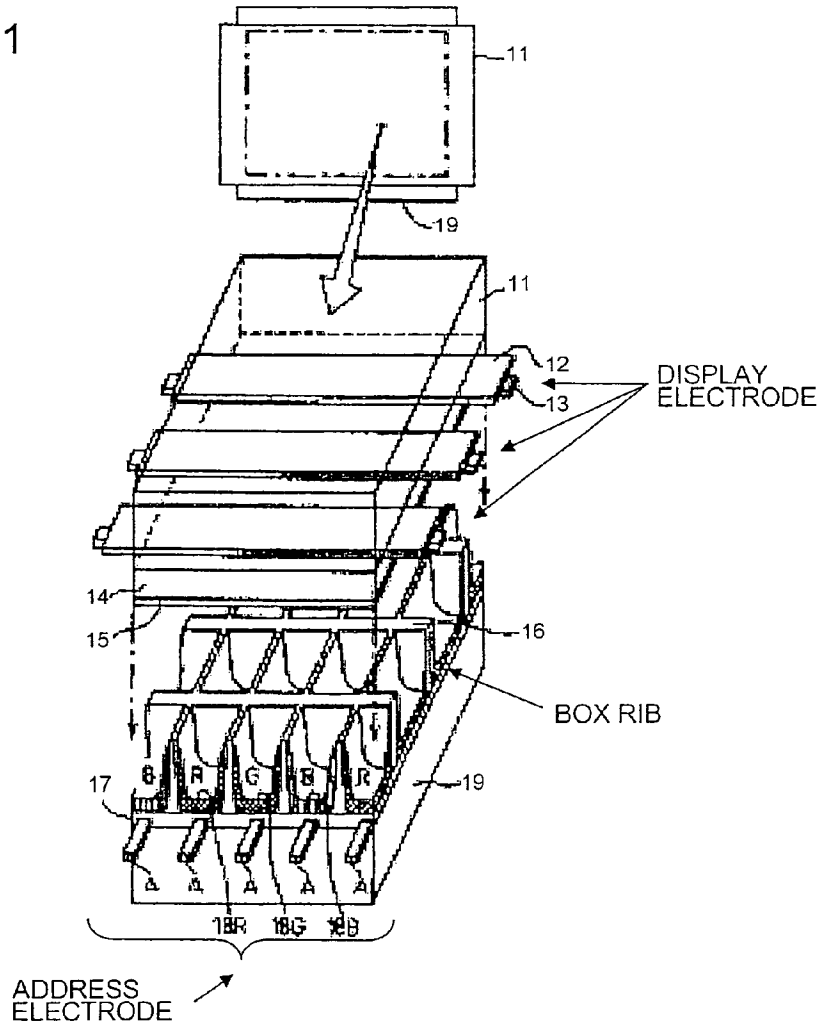
FIG. 1 is a diagram illustrating a BOX-ALIS panel.
Figure 2:
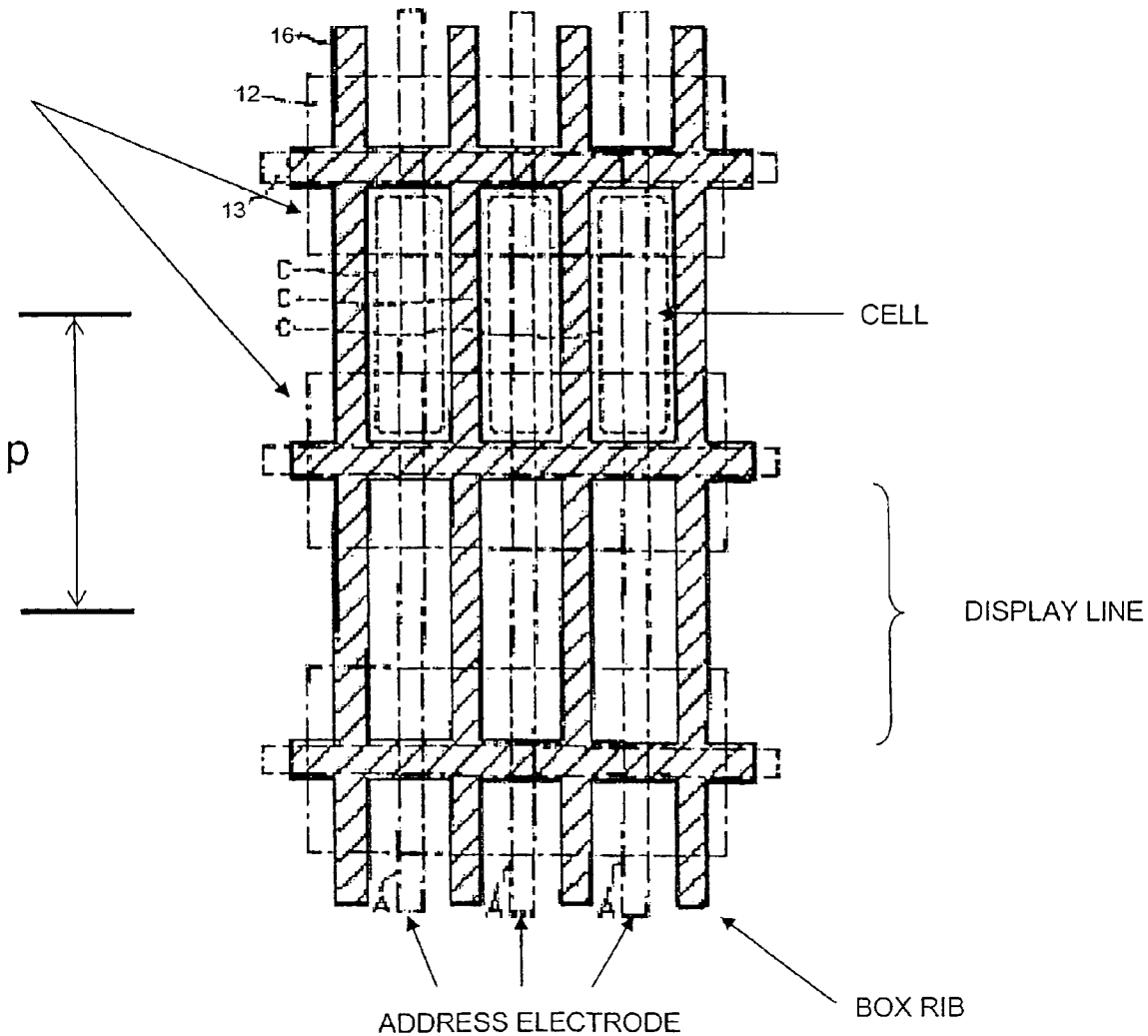
FIG. 2 is a diagram illustrating the positional relationship between a rib and electrodes.

A first embodiment will be described. FIG. 1 shows the panel structure of the plasma display module of this embodiment. The panel will be referred to as a BOX-ALIS panel in the sense that it is an ALIS panel combined with a BOX rib. FIG. 2 shows the positional relationship between a BOX rib and electrodes when the panel is seen as a plane. The discharge space is divided into rectangles by the BOX rib to form cells. One horizontal row of cells form a horizontal-direction display line. Hereinafter, a "display line" means a horizontal-direction line unless otherwise specified. A line pitch means the interval between the middles of adjacent display lines.

Figure 3:
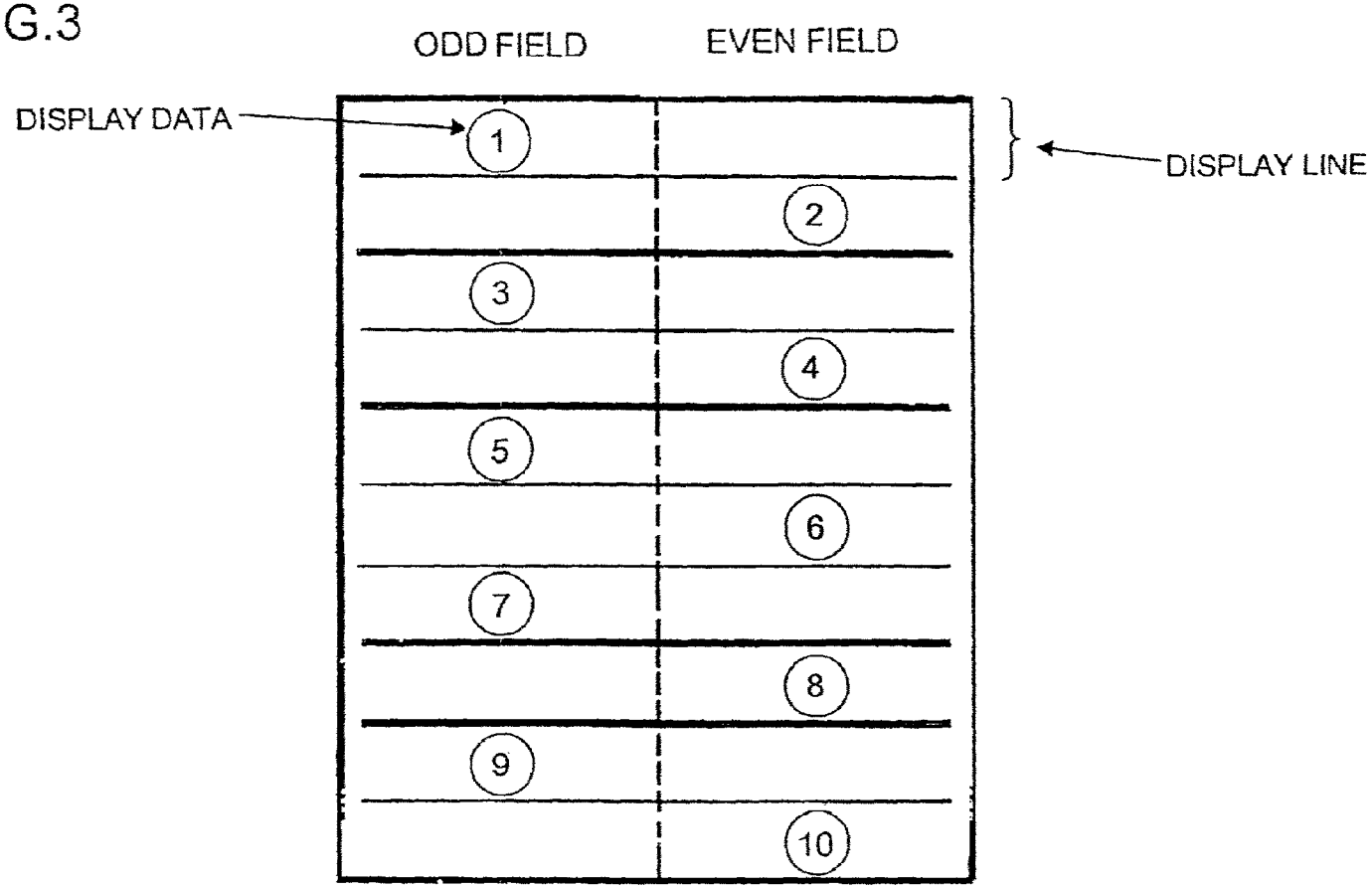
PRIOR ART FIG.3
FIG. 3 is a diagram illustrating the display format of ordinary interlace display.

When ordinary interlace display (interlace display by one-line display) is performed with this BOX-ALIS, the display format is as shown in FIG. 3. In the odd field, data of odd lines are displayed by the cells of the odd lines, and, in the even field, data of even lines are displayed by the cells of the even lines.

In comparison, in the technique of Patent Document 2, interlace display for displaying the same data by two lines is performed. In this case, there is not an inactive line in each field, unlike the ordinary interlace display. However, if two lines combined as a pair in each field is regarded as one line, display is shown with display line positions in the odd and even fields displaced from each other. In this meaning, such display is also referred to as interlace display in the present invention. Furthermore, in the description below, an example of a display format is shown in which the light emission ratio of two lines is other than 1, and such display is regarded as an expansion of the concept and also referred to as interlace display.

Figure 4:
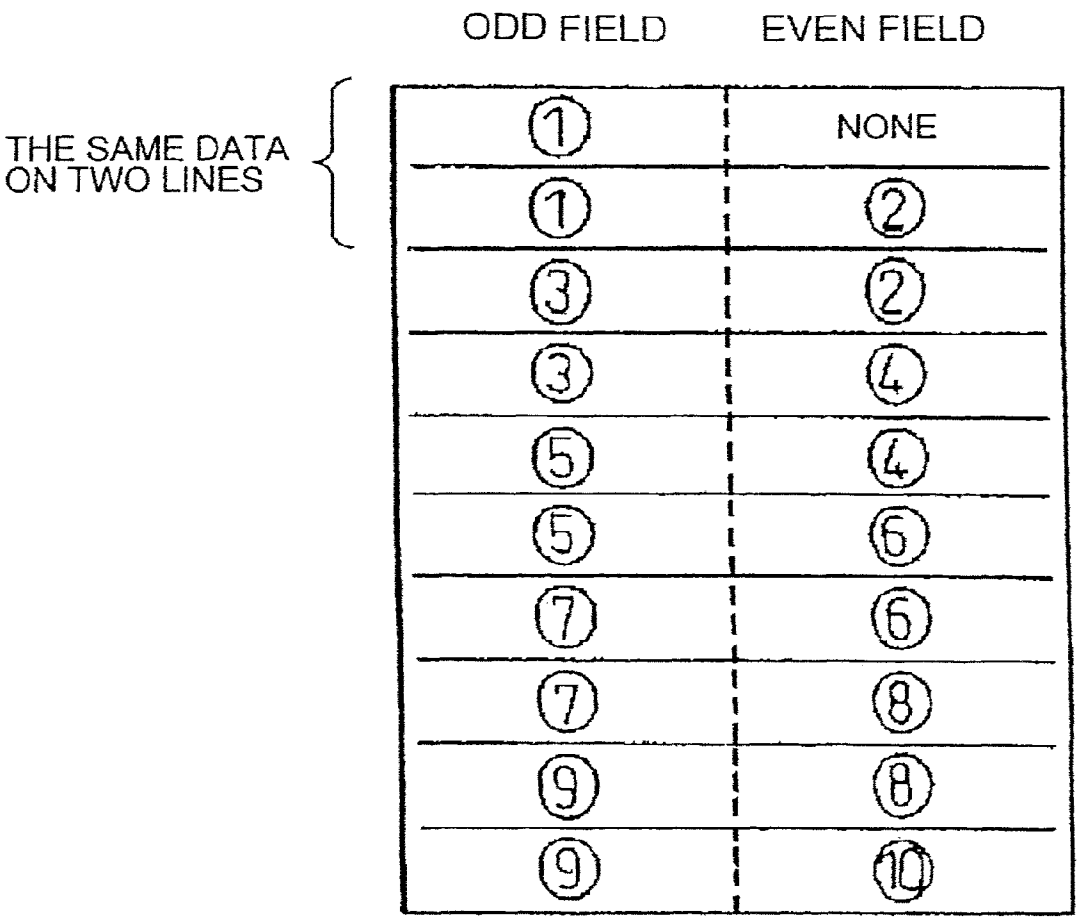
PRIOR ART FIG.4
FIG. 4 is a diagram illustrating interlace display by two-line display.

FIG. 4 shows the display format in the case of interlace display by two-line display. In the odd field, data of an odd line is displayed with adjacent two lines with the odd line on the upper side. In the even field, data of an even line is displayed with adjacent two lines with the even line on the upper side.

As seen from the display formats in FIGS. 3 and 4, the luminance per electrical discharge in case of the interlace display by two-line display is almost twice as high. As seen from comparison of the displays in FIGS. 3 and 4, the interlace display by two-line display is such that two images of interlace display by one-line display are displaced from each other by the amount corresponding to one line pitch and overlapped with each other. As described above, such display corresponds to the result of applying a lowpass filter to the original image, and the resolution deteriorates.

In this embodiment, display is performed by combination of the interlace display by one-line display and the interlace display by two-line display.

Figure 5:
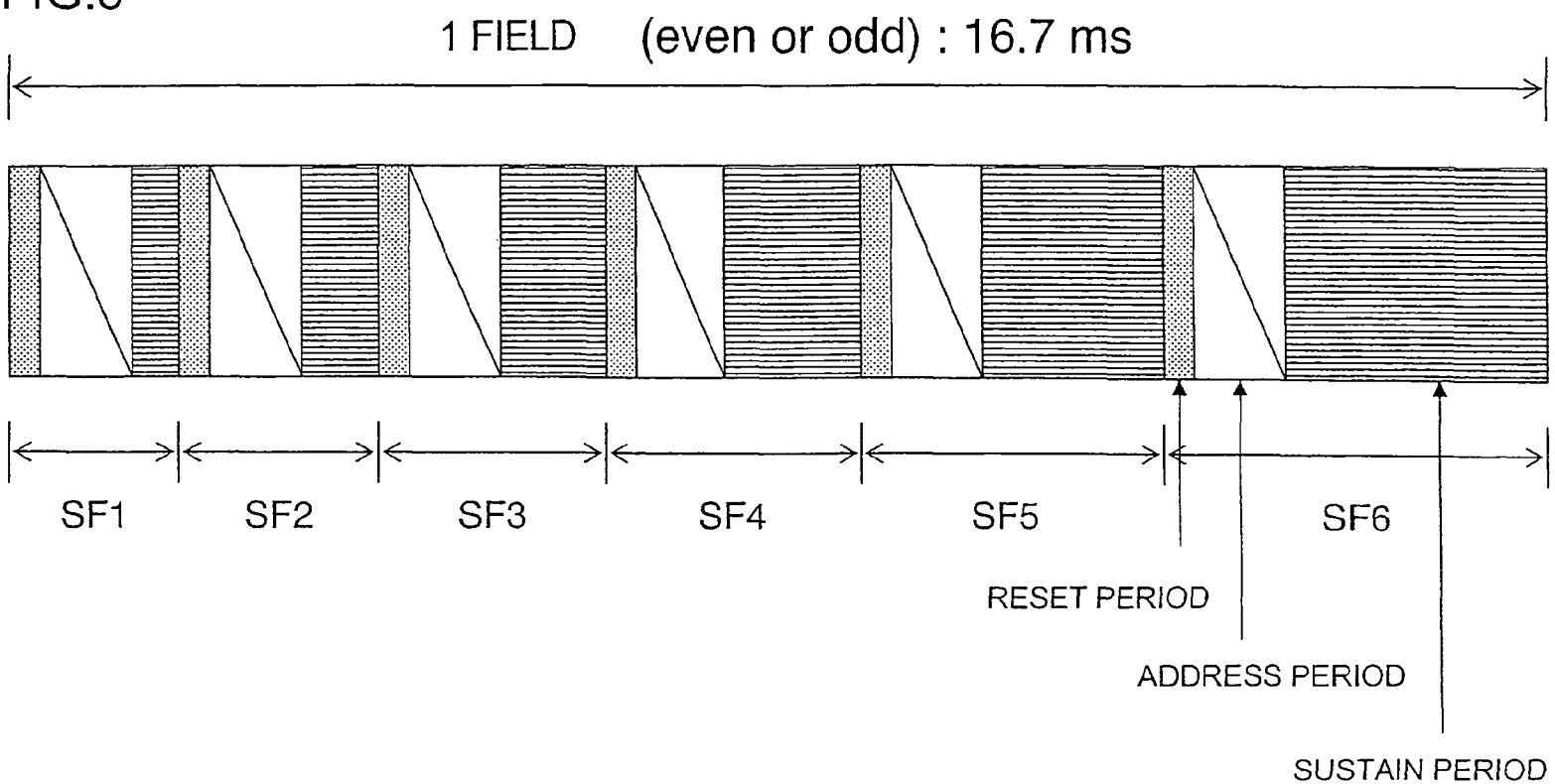
FIG. 5 is a diagram illustrating the driving configuration of a standard plasma display panel.

Next, in order to describe this combination display, the driving configuration of a standard PDP will be described first with reference to FIG. 5. One field (odd/even) is configured by multiple subframes (SFs). Though FIG. 5 shows a configuration by six SFs for convenience of drawing, a configuration by ten SFs or twelve SFs is common in general. One SF is configured by a reset period, an address period and a sustain period. In the reset period, the wall charge state on electrodes is initialized. In the address period, the wall charge state is adjusted on the basis of display data. In the sustain period, cells corresponding to the display data are lighted. During one sustain period, one cell is lighted through the period or does not light up at all through the period. By selecting during which SFs the cell is to be lighted, the tone is expressed.

Figure 6:
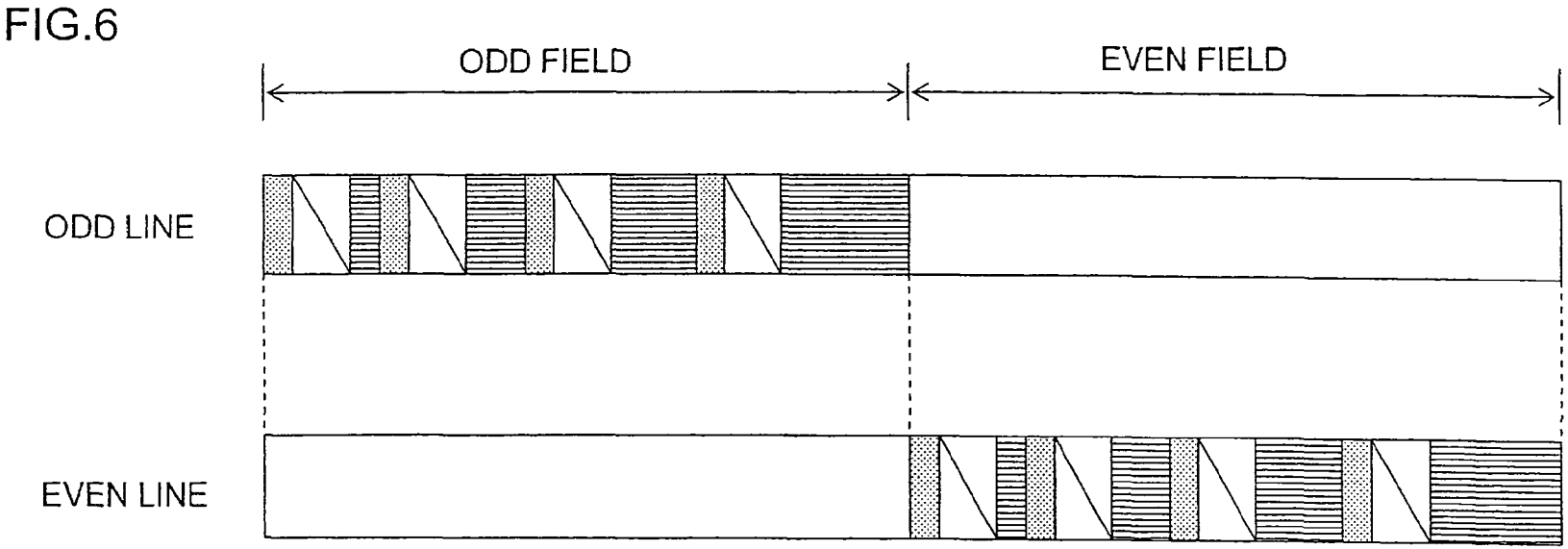
FIG. 6 is a diagram illustrating a one-line display interlace driving configuration in a first embodiment.
Figure 7:
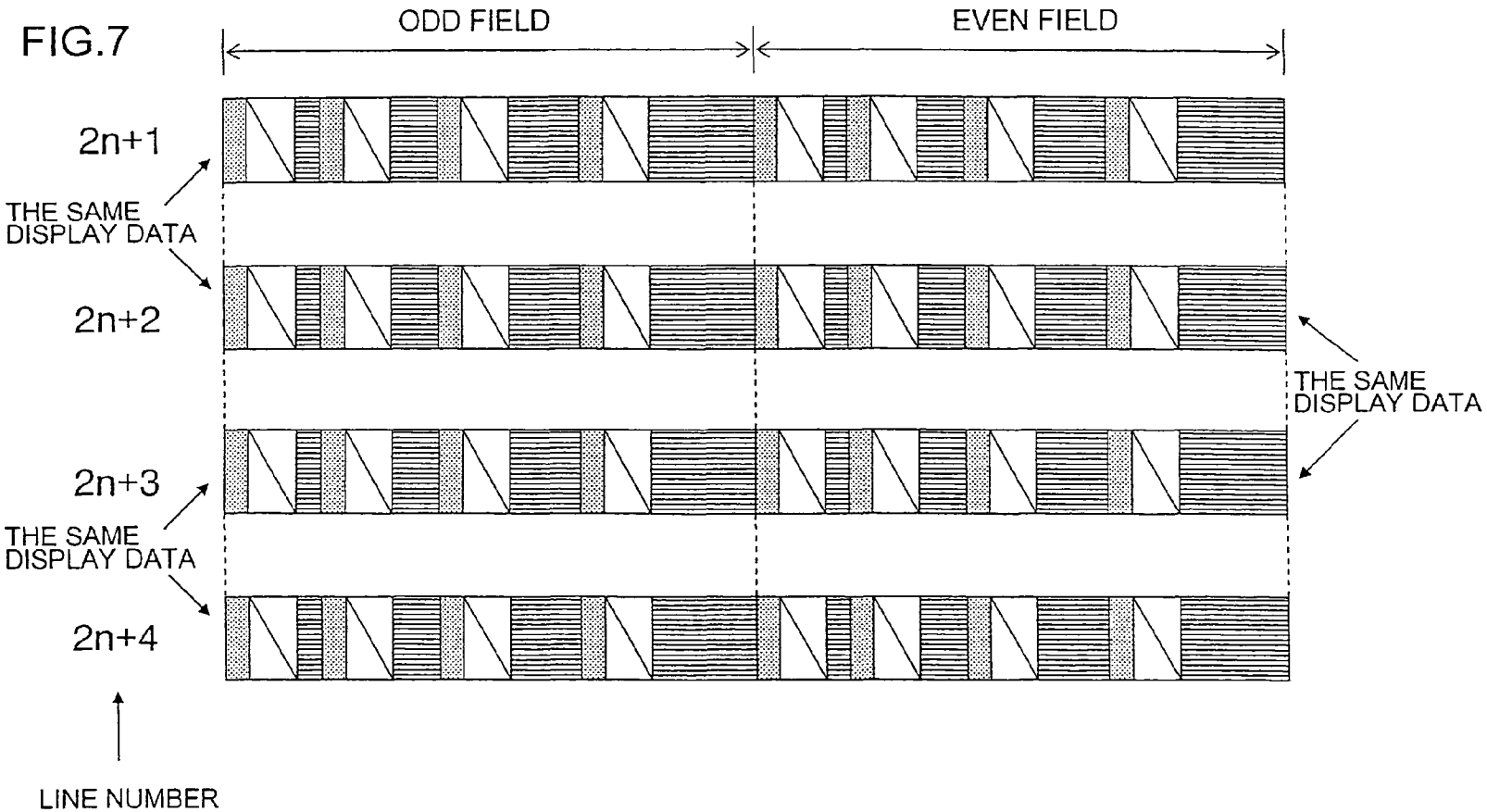
FIG. 7 is a diagram illustrating a two-line display interlace driving configuration in the first embodiment.

FIG. 6 shows the driving configuration of the interlace display by one-line display. FIG. 6 shows a configuration by four SFs for the convenience of drawing. In one field, half of lines are not lighted. On the other hand, in the technique of Patent Document 2, all the lines are lighted, and adjacent two lines indicate the same data, as shown in FIG. 7.

Figure 8:
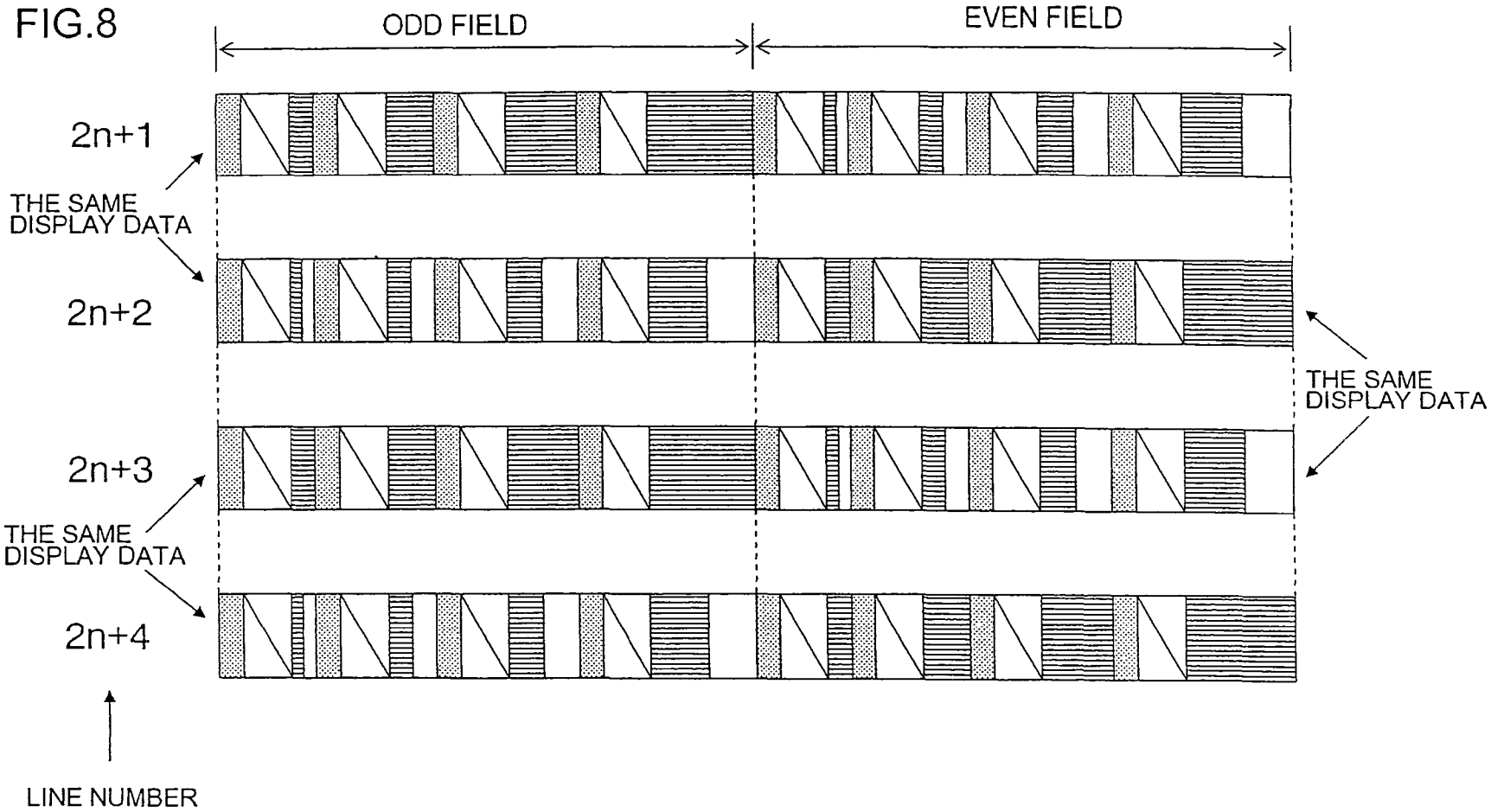
FIG. 8 is a diagram illustrating a driving configuration in the first embodiment.
Figure 9:
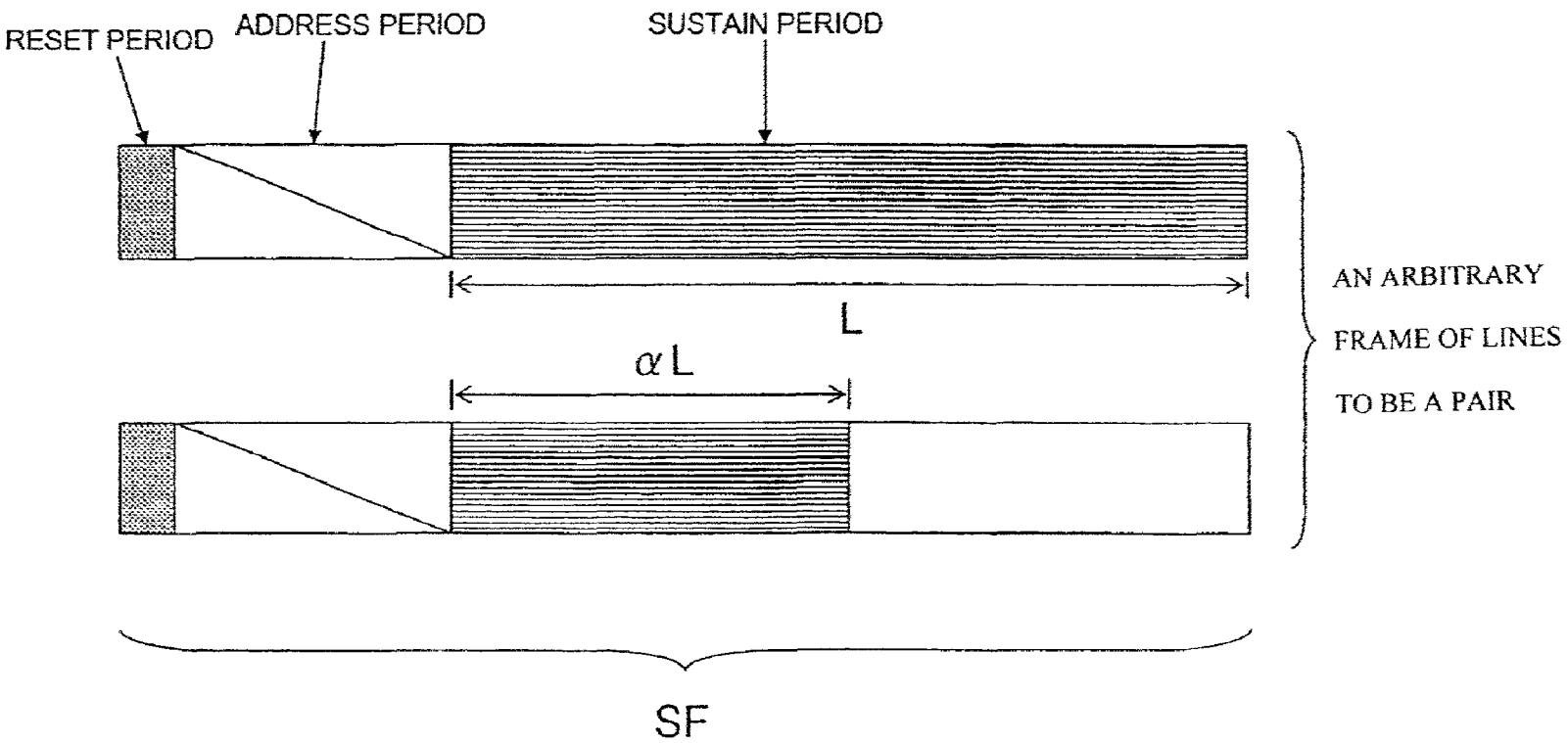
FIG. 9 is a diagram illustrating the configuration of a subframe in the first embodiment.

In this embodiment, two-line display is performed partially to suppress deterioration of resolution. FIG. 8 shows the driving configuration of this embodiment. For one of two lines combined as a pair (though it is the line on the lower side in FIG. 8, the line on the upper side is also possible), the number of display discharges is reduced at a predetermined rate relative to that of the other line. Thereby, an image by intermediate display between the one-line display and the two-line display is obtained. It is assumed now that the ratio of the less number of sustain discharges to the other number of discharges is denoted by a, wherein $0<\alpha<1$ is satisfied. That is, if the luminance obtained when all the SFs of the line for which the number of sustain discharges is not reduced are lighted is assumed to be 1, the luminance obtained when all of the SFs of the other line are lighted is a. Hereinafter, a is also referred to as a "two-line lighting ratio". In order to improve the luminance, $\alpha$ is desirably required to be 0.05 or more even in consideration of variation in manufacture. Furthermore, in order to obtain the effect of more improvement of the luminance, $\alpha$ is preferably required to be 0.2 or more. On the other hand, in order to clearly obtain the effect of improvement of the resolution, a is preferably required to be 0.8 or less. More preferably, it is desirable that .alpha. is 0.5 or less. FIG. 9 shows the driving configuration of one extracted SF. In this case, when the display data of a certain vertical-direction line is denoted by s(y), the displayed average image of the odd field and the even field is expressed as follows:

[Formula 3]

$$g(y) = \frac{1}{1+\alpha}(\alpha s(y+p) + s(y)) \tag{3}$$

The effect $h_A(\alpha, f)$ of the lowpass filter which operates on the vertical direction is expressed as follows:

[Formula 4]

$$h_A(\alpha, f) = \frac{1}{1+\alpha}\sqrt{1 + 2\alpha\cos(2\pi pf) + \alpha^2} \tag{4}$$

It is known that the resolution has been improved in comparison with the interlace image by the two-line display of the Patent Document 2 expressed by Formula (1). For example, when the values of Formula (2) and Formula (4) are compared at the point of f=½p, which is the theoretical upper limit of the space frequency which can be displayed on the panel, the following is obtained:

[Formula 5]

$$\left.\begin{aligned} h_f\left(\frac{1}{2p}\right) &= 0 \\ h_A\left(\alpha, \frac{1}{2p}\right) &= \frac{1-\alpha}{1+\alpha} > 0 \end{aligned}\right\} \tag{5}$$

Thus, the resolution of this embodiment is higher.

Figure 10:
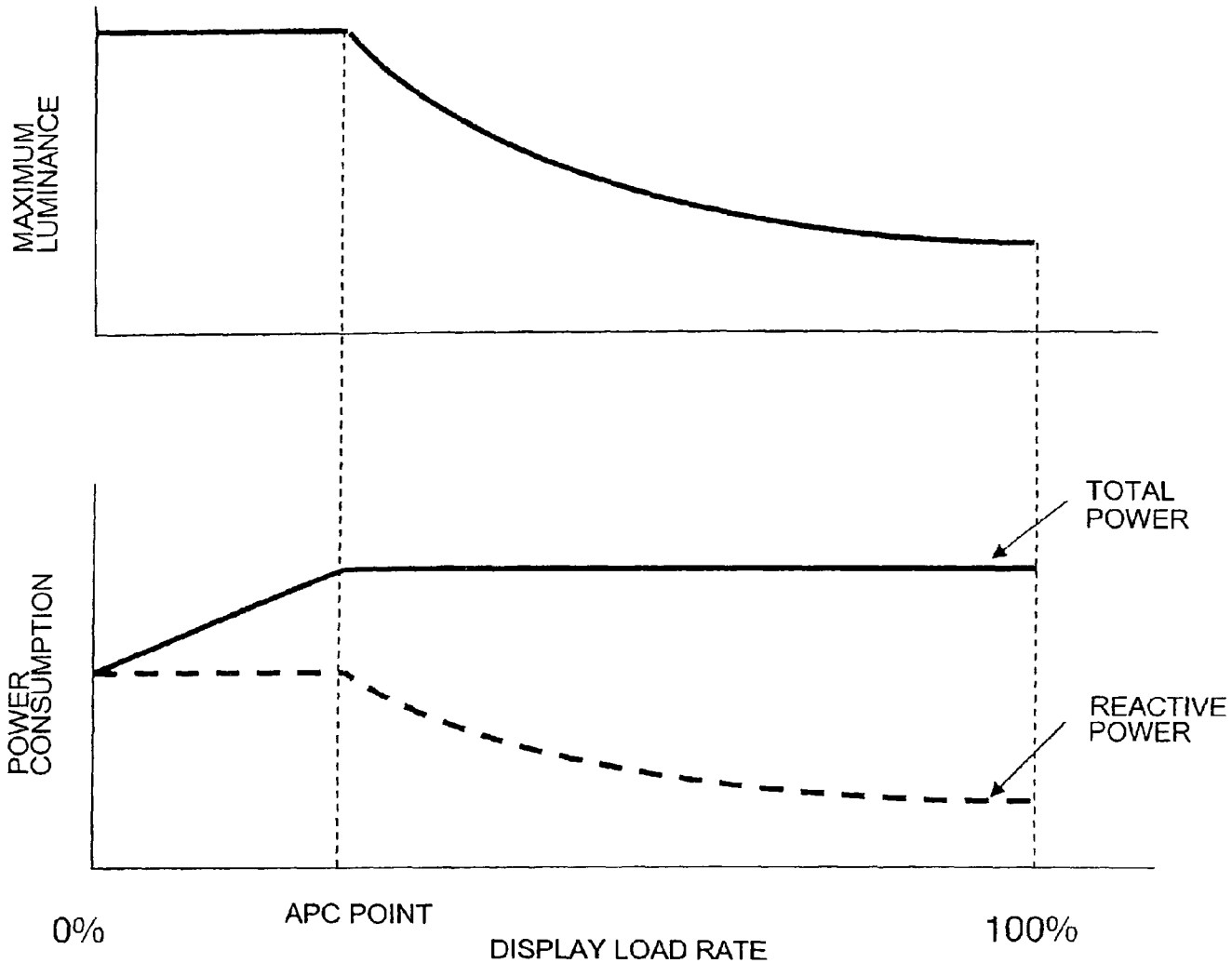
FIG. 10 is a diagram illustrating APC control.

Next, comparison will be made on luminance. Prior to the comparison, the APC control in a PDP will be described. Because the essence of the argument is not changed, it is assumed that the power consumption of the PDP is only the power consumption during the sustain period. In this case, the power consumed during the sustain period is composed of discharge power which directly contributes to light emission and reactive power which is consumed when the capacity between electrodes is charged/discharged. FIG. 10 shows the relationship between the maximum luminance relative to the display load rate (the luminance at the maximum tone) and power consumption. The maximum luminance and the reactive power are almost proportional to the sustain frequency. Below the APC point, the sustain frequency (the maximum luminance and the reactive power) are kept constant, and, above the APC point, the sustain frequency (the maximum luminance and the reactive power) decreases as the load rate increases. On the other hand, below the APC point, the total power increases as the load rate increases, and, above the APC point, the total power is kept constant. The APC control described above is APC control commonly performed.

On the assumption of this APC control, the maximum luminance during the two-line display will be considered. As an example, a panel with 42 inches between opposite corners, the number of pixels: 1024×1024 (aspect ratio: 16:9), and discharge gas: Xe 8%+He 30%+Ne 62% (500 Torr) will be described. First, when the sustain frequency is 60 kHz, the maximum luminance at and below the APC point is 618 cd/m$^2$ in the case of one-line lighting and 1215 cd/m$^2$ in the case of two-line lighting (the two-line lighting rate: 100%). The luminance almost twice as high is obtained by using the two-line lighting. On the other hand, when the display load rate is 100% and the total power is 263 W, the maximum luminance is 210 cd/m$^2$ in the case of one-line lighting and 222 cd/m$^2$ in the case of two-line lighting (the two-line lighting rate: 100%). The luminance is improved only by 6% even if the two-line lighting is used. This is because, above the APC point, control for keeping the total power constant is performed. By using the two-line lighting, the luminance per sustain cycle becomes almost twice as high, but the power consumption also increases. Therefore, under the control for keeping the total power constant, the sustain frequency during the two-line lighting decreases in comparison with the sustain frequency during the one-line lighting, and, as a result, the maximum luminance increases little. In the case of the one-line lighting, the composition of the power consumption when the display load rate is 100% is as follows: discharge power of 204 W and reactive power of 59 W. The sustain frequency is 26 kHz. In the case of the two-line lighting (the two-line lighting rate: 100%), the composition is as follows: discharge power of 215 W and reactive power of 48 W. The sustain frequency is 14 kHz. By using the two-line lighting, the discharge power per sustain cycle becomes twice as much, and the reactive power becomes 1.5 times as much. The 6% increase of the luminance is due to the effect of the ratio of the reactive power to the total power being decreased by the use of the two-line lighting.

Figure 11:
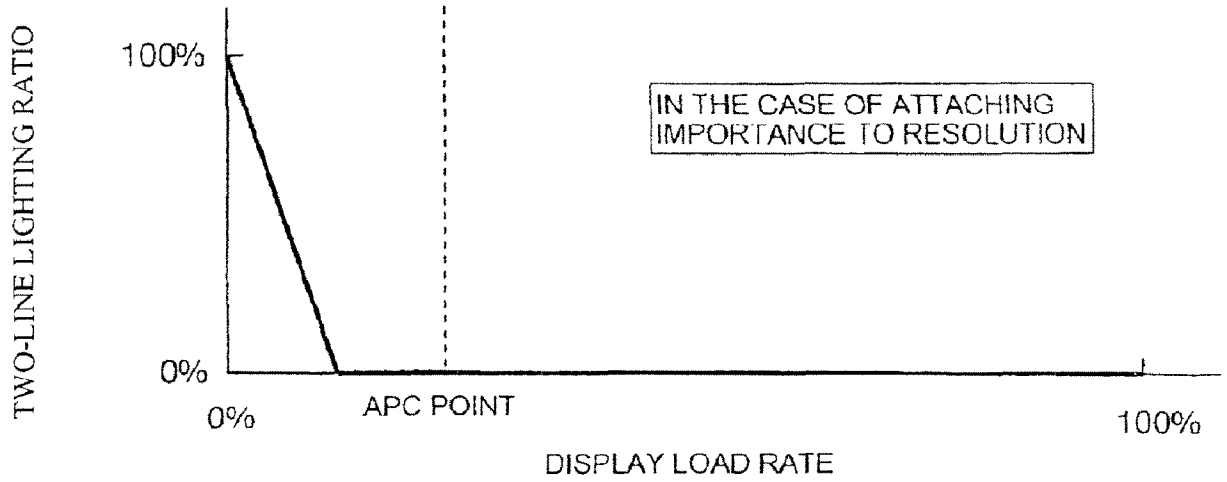
FIG. 11 is a diagram illustrating two-line lighting ratio control.
Figure 11:
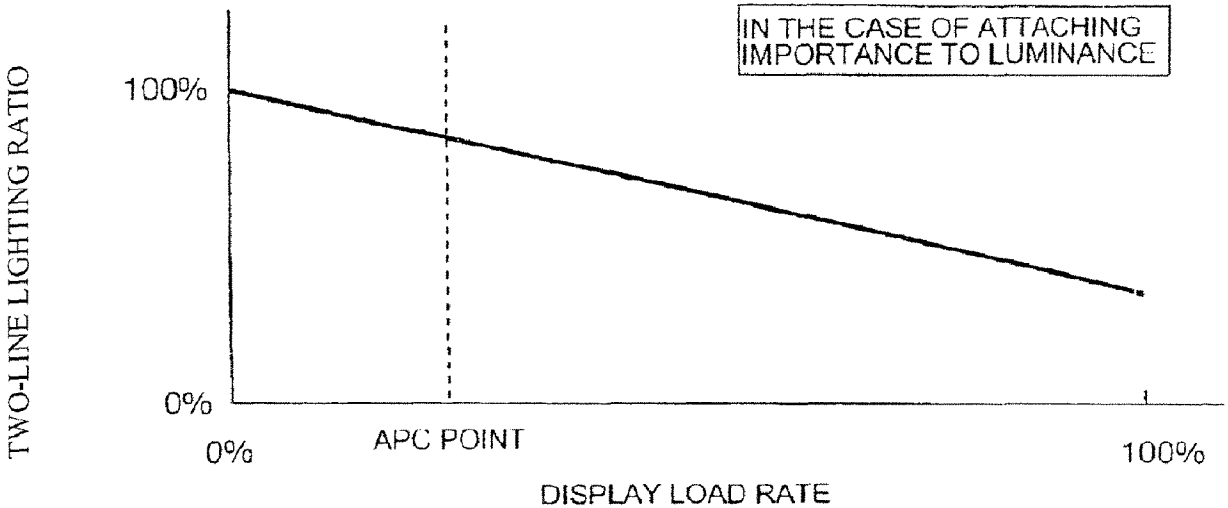

As described above, below the APC point, the luminance increase effect due to the use of the two-line lighting is very high, but the luminance increase effect is little when the display load rate is 100%. Therefore, by performing control for decreasing the two-line lighting rate ratio to obtain a high-resolution image in an area with a high load rate, and, on the contrary, increasing the two-line lighting ratio to obtain a high-luminance image in an area with a low load rate, a well-balanced display image is obtained. FIG. 11 shows an example of the control, wherein the two-line lighting ratio is indicated as a function of the display load rate. For example, in the case of attaching importance to resolution, the two-line display is performed only for areas with a display load rate below the APC point, and the two-line lighting ratio is increased as the load rate decreases beginning from a certain value (for example, 10%) (see FIG. 11(*a*)). The two-line lighting ratio may be 100% at and below a certain load rate (for example, 5%). On the other hand, in the case of attaching importance to luminance, it is possible to perform control for performing the two-line display for areas including the areas with a display load rate above the APC point (see FIG. 11(*b*)). It is also possible to, for simplification of the control, keep the two-line lighting ratio constant irrespective of the load rate and determine the value of the two-line lighting ratio depending on the balance between the luminance and the resolution.

Figure 12:
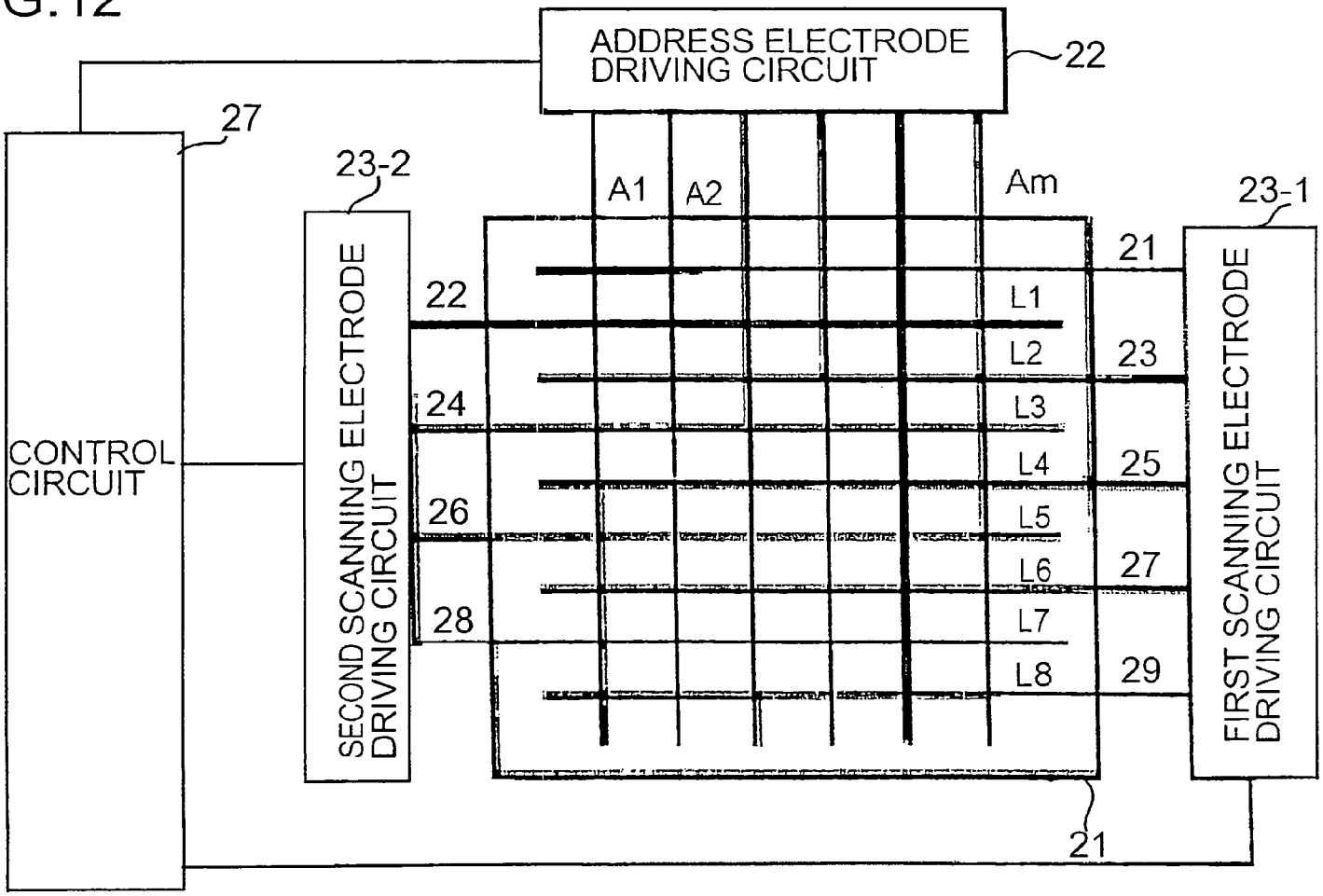
FIG. 12 is a diagram illustrating the configuration of a driving circuit of the first embodiment.

Finally, FIG. 12 shows the configuration of the driving circuit of the first embodiment, and FIGS. 13 to 16 show the driving waveforms. There are provided an address electrode driving circuit 22, first and second scanning electrode driving circuits 23-1 and 23-2, and a control circuit 27. The control circuit 27 generates a subframe signal from an input picture signal, and performs signal processings such as generation of a control signal for driving the electrode as described above for each field. Furthermore, processing for converting an input picture signal to an interlace signal is also performed if the input picture signal is a progressive signal. In this case, a Y electrode (second scanning electrode) is used as a scanning electrode during the odd field period, and an X electrode (first scanning electrode) is used as the scanning electrode during the even field period. Therefore, a scanning circuit is attached to both of the X electrode (first scanning electrode) and the Y electrode (second scanning electrode).

Figure 13:
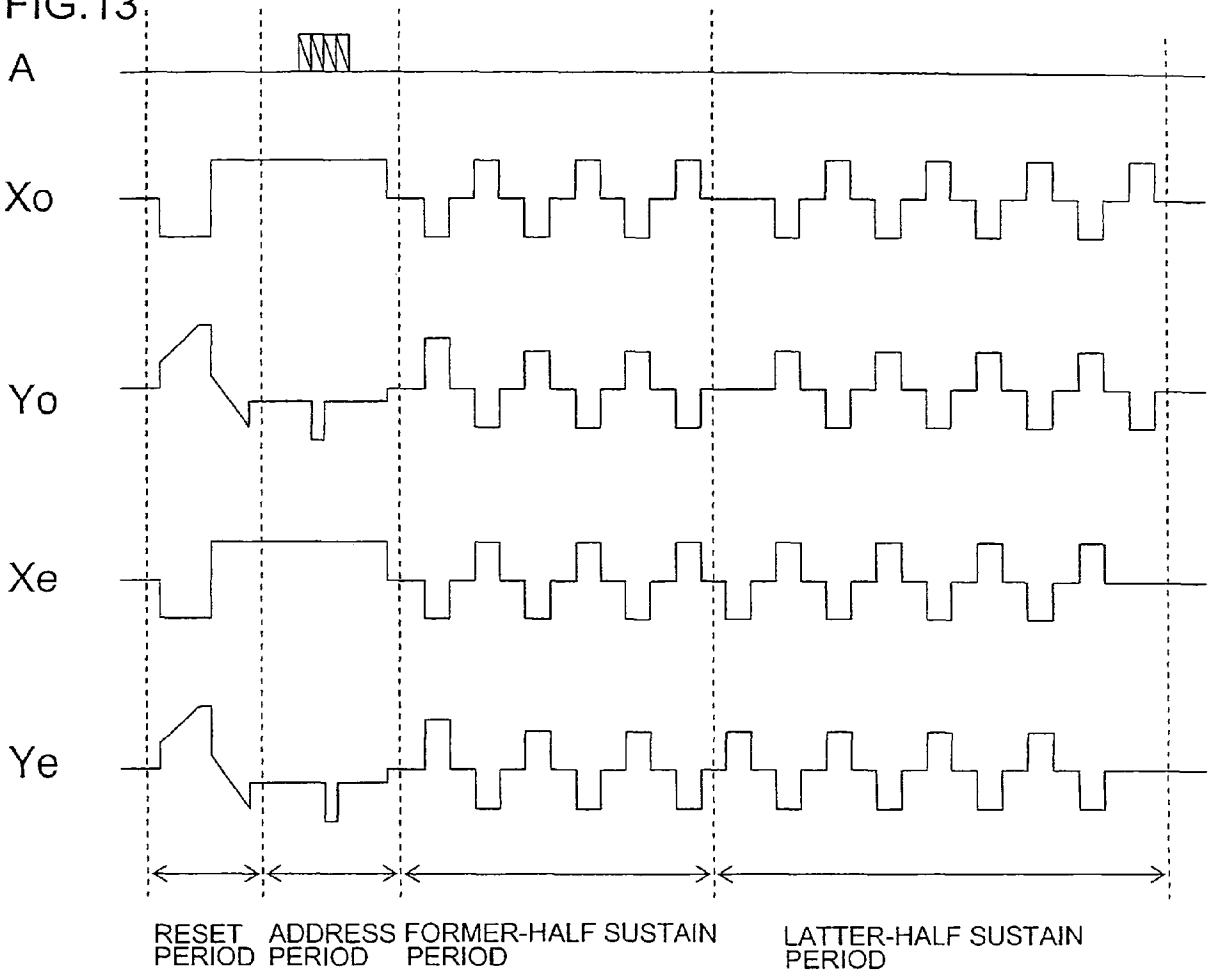
FIG. 13 is a diagram illustrating driving waveforms (odd field) in the first embodiment.
Figure 14:
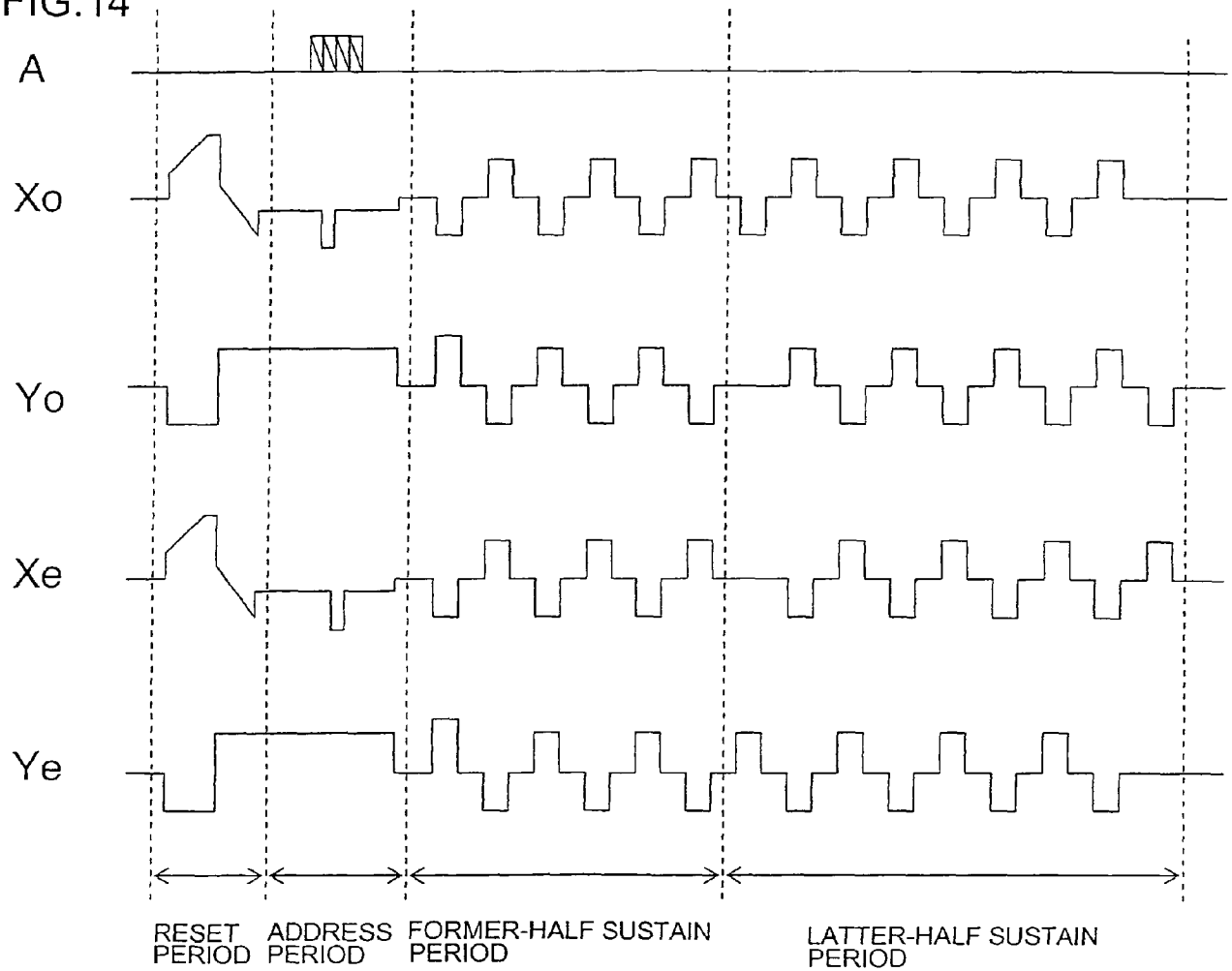
FIG. 14 is a diagram illustrating driving waveforms (even field) in the first embodiment.
Figure 15:
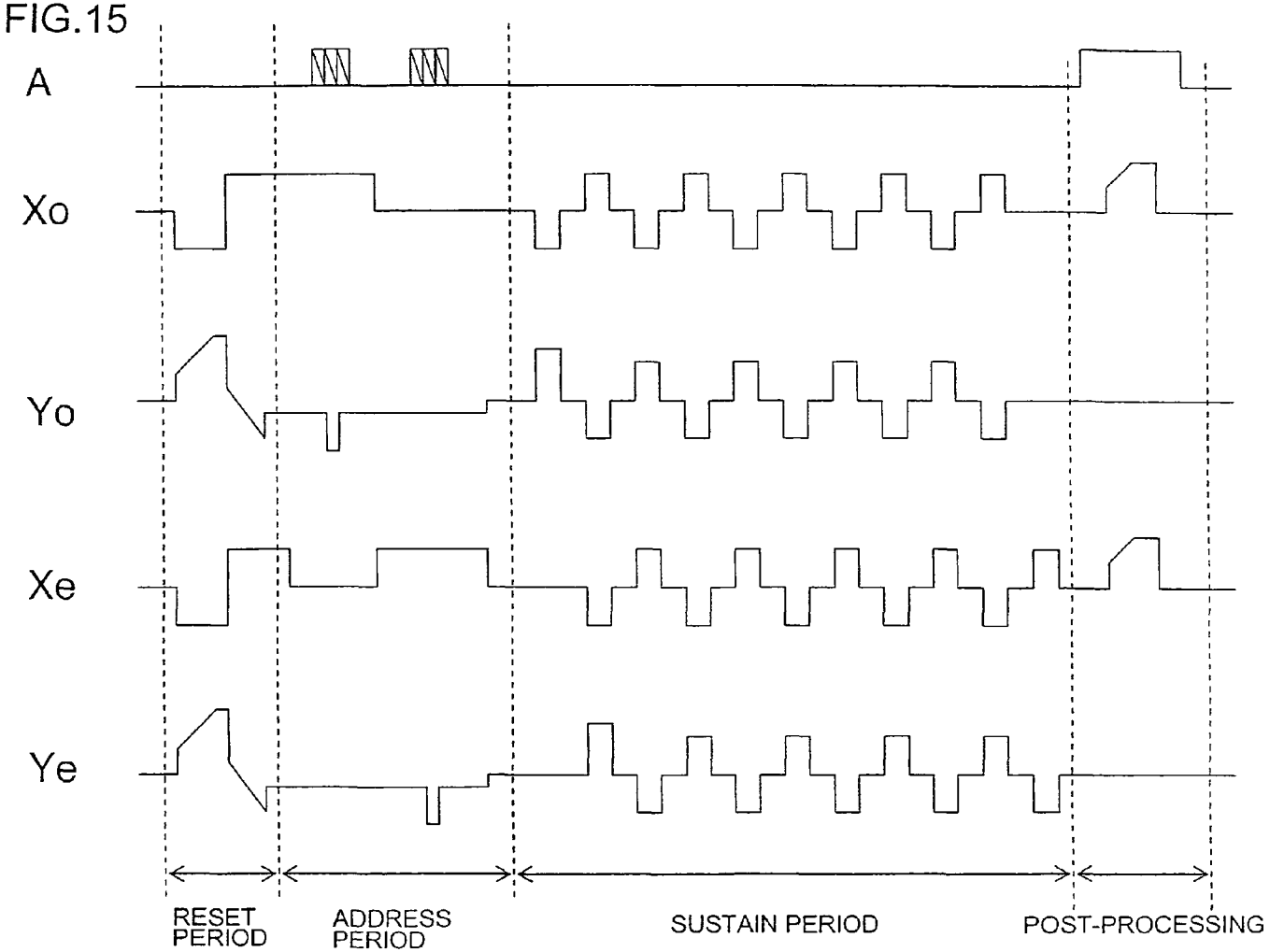
FIG. 15 is a diagram illustrating driving waveforms (in the case of $\alpha=0$; odd field) in the first embodiment.
Figure 16:
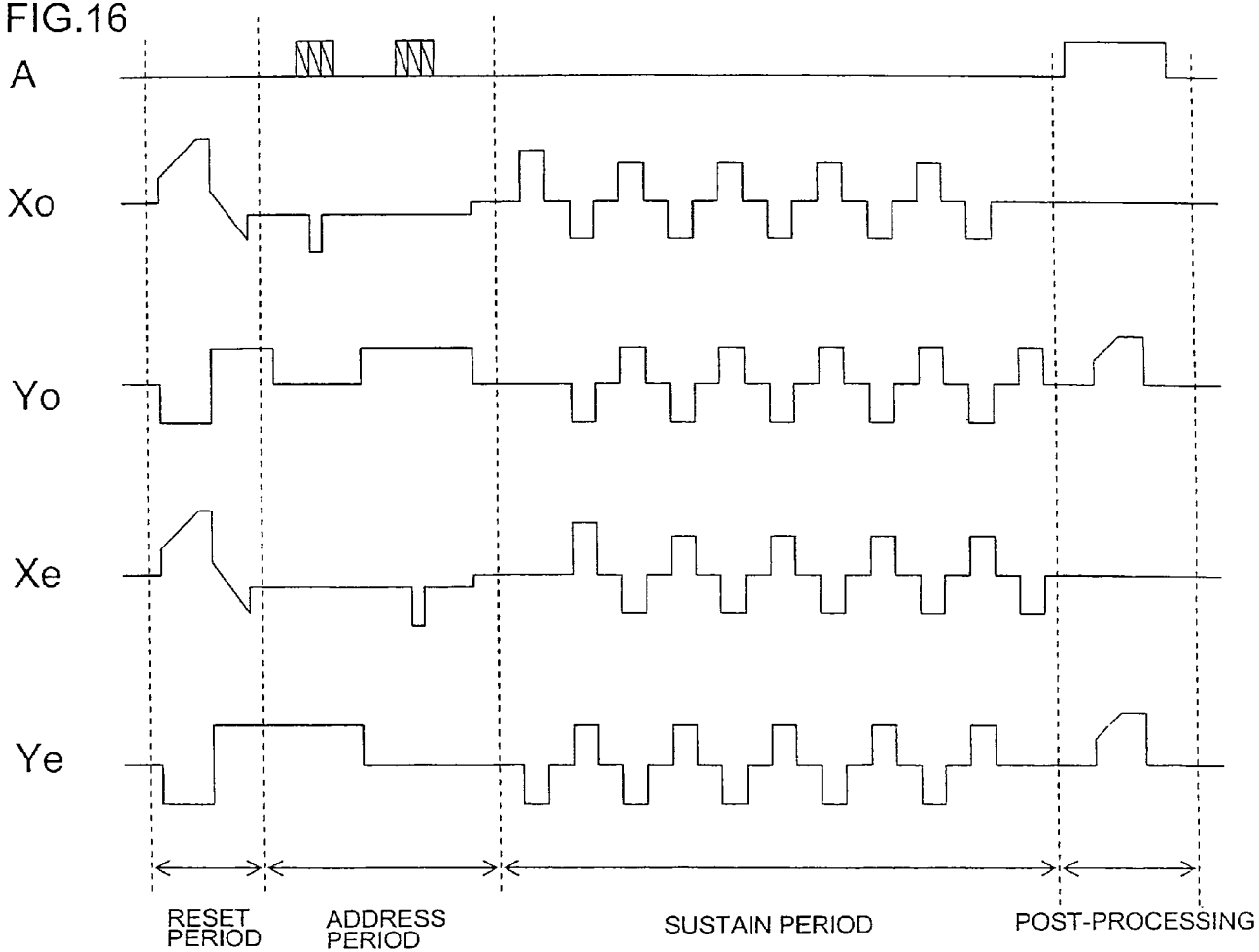
FIG. 16 is a diagram illustrating driving waveforms (in the case of $\alpha=0$; even field) in the first embodiment.

FIGS. 13 and 14 show standard driving waveforms, which are waveforms in the case of performing the two-line lighting. In the case of complete two-line lighting, the waveforms become waveforms without the latter-half sustain period shown in FIGS. 13 and 14. In the case of complete one-line lighting, the driving waveforms differ a little and become waveforms as shown in FIGS. 15 and 16. That is, if only A-Y discharge occurs during the address period and sustain discharge does not occur, it may occur that the next reset does not operate well. Therefore, a post-processing pulse for such a case is provided.

Second Embodiment

A second embodiment will be described. Though there is a scanning circuit only for the Y electrode in the driving circuit of an ordinary PDP, the driving circuit of the first embodiment is provided with a scanning circuit for the X electrode also. This is a disadvantage from the viewpoint of cost. Accordingly, in the second embodiment, a configuration is shown in which the scanning circuit is provided only for the Y electrode.

Specifically, by fixing the pair of two lines, without changing it according to fields, scanning is performed only by the Y electrode. That is, two lines with the Y electrode between them is combined as a pair irrespective of the field. However, it is the same as the first embodiment that the odd line is a main line in the odd field, and the even line is a main line in the even field.

Figure 17:
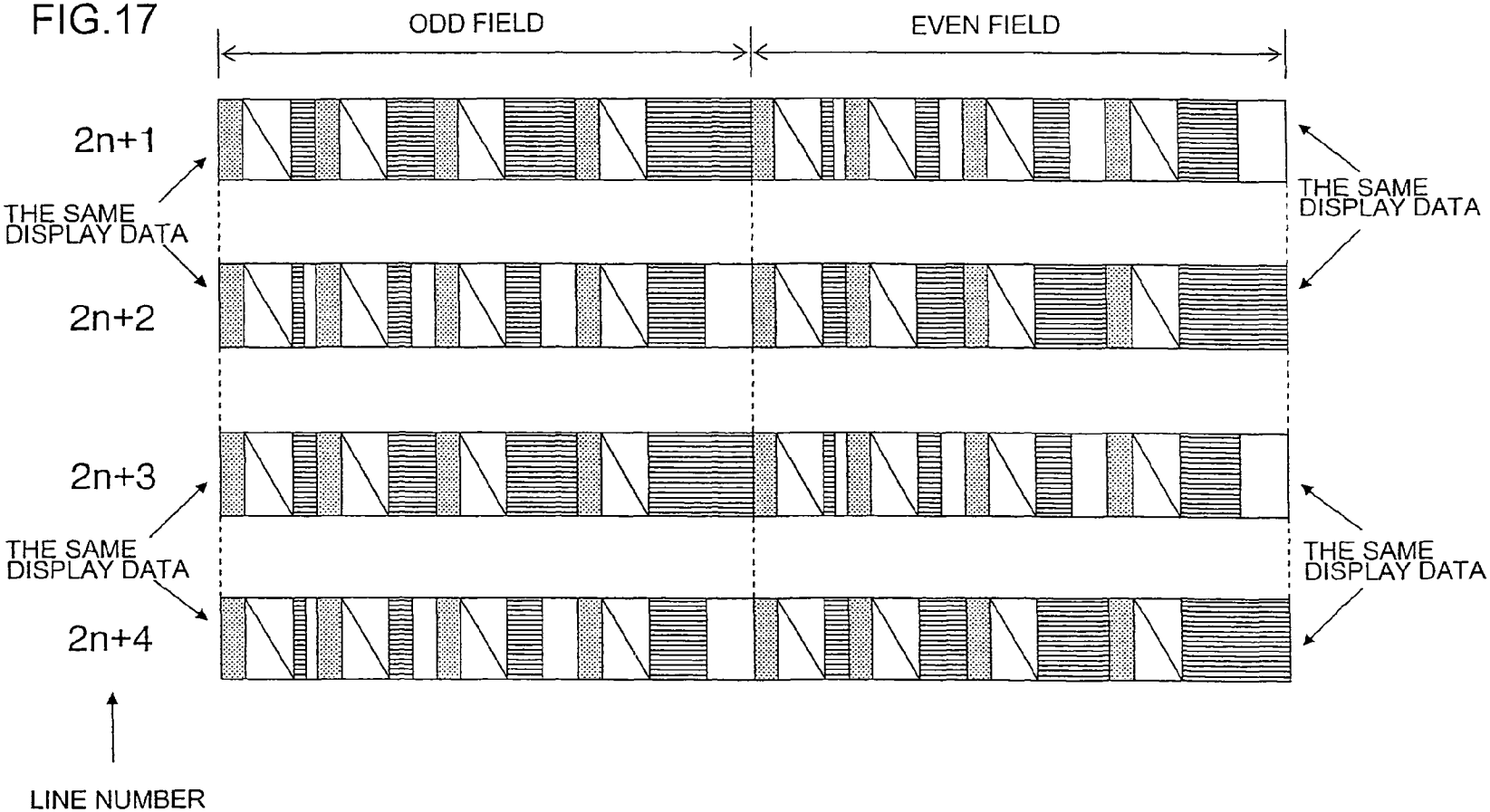
FIG. 17 is a diagram illustrating a driving configuration in a second embodiment.
Figure 18:
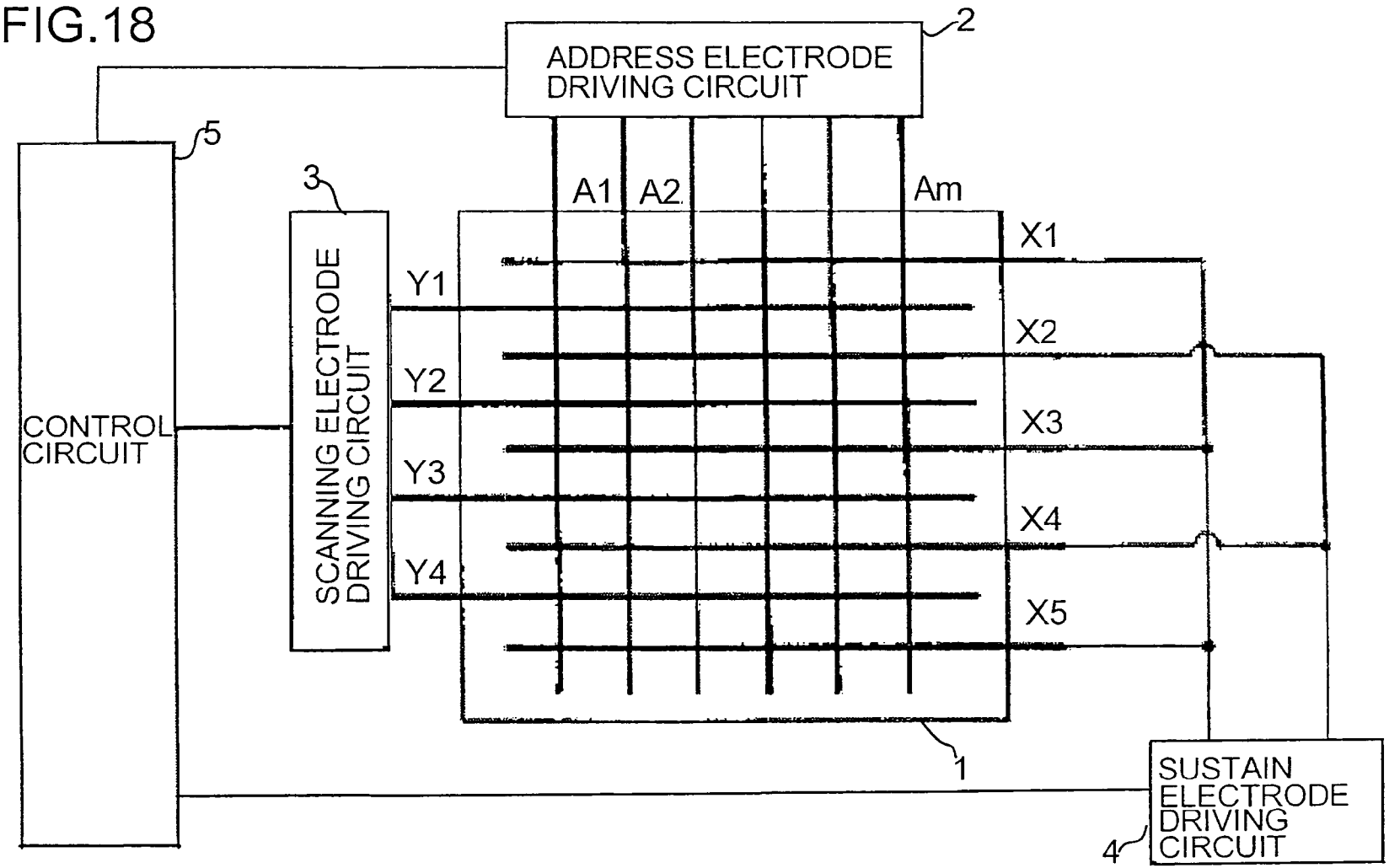
FIG. 18 is a diagram illustrating a driving circuit of the second embodiment.
Figure 19:
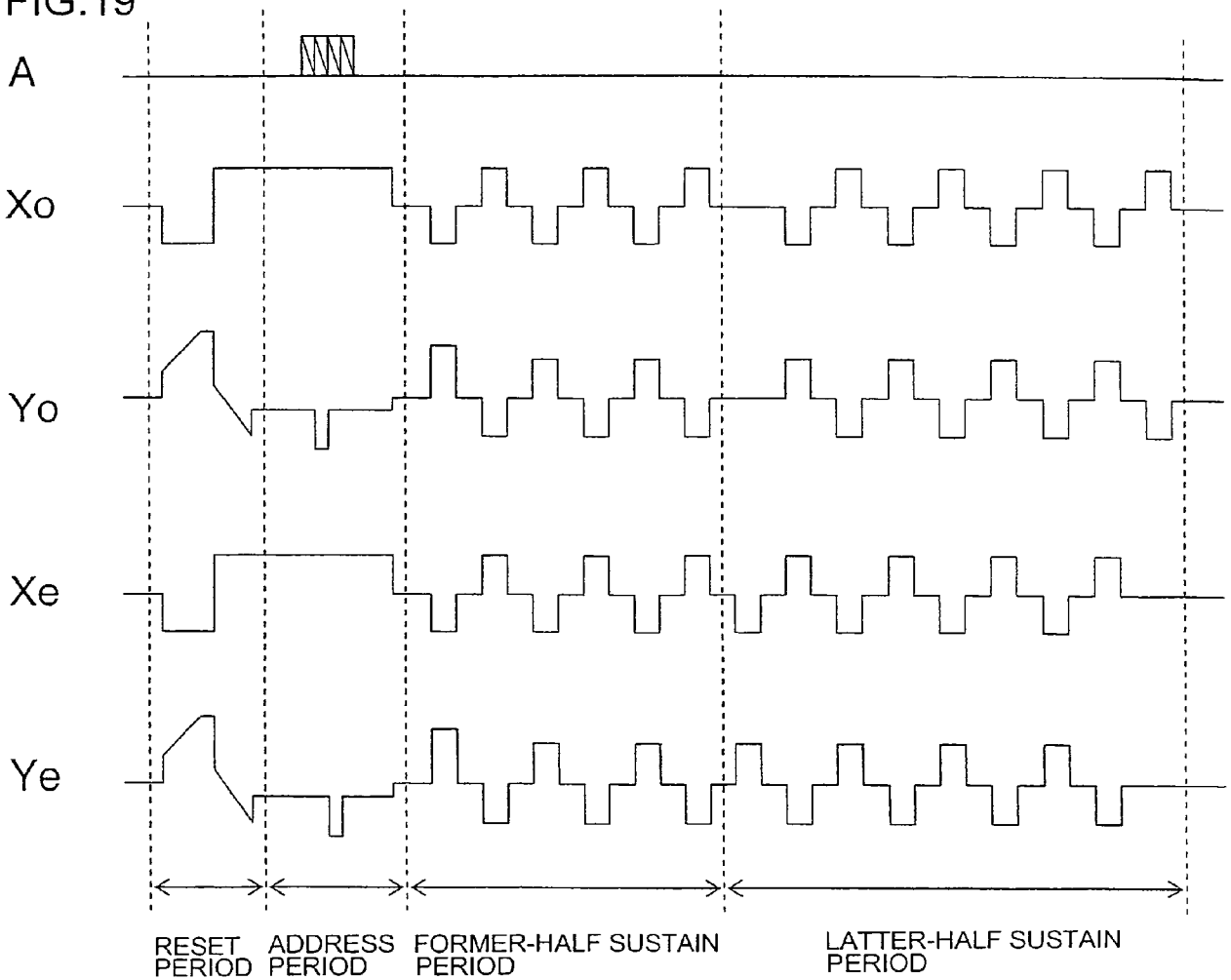
FIG. 19 is a diagram illustrating driving waveforms (odd field) in the second embodiment.
Figure 20:
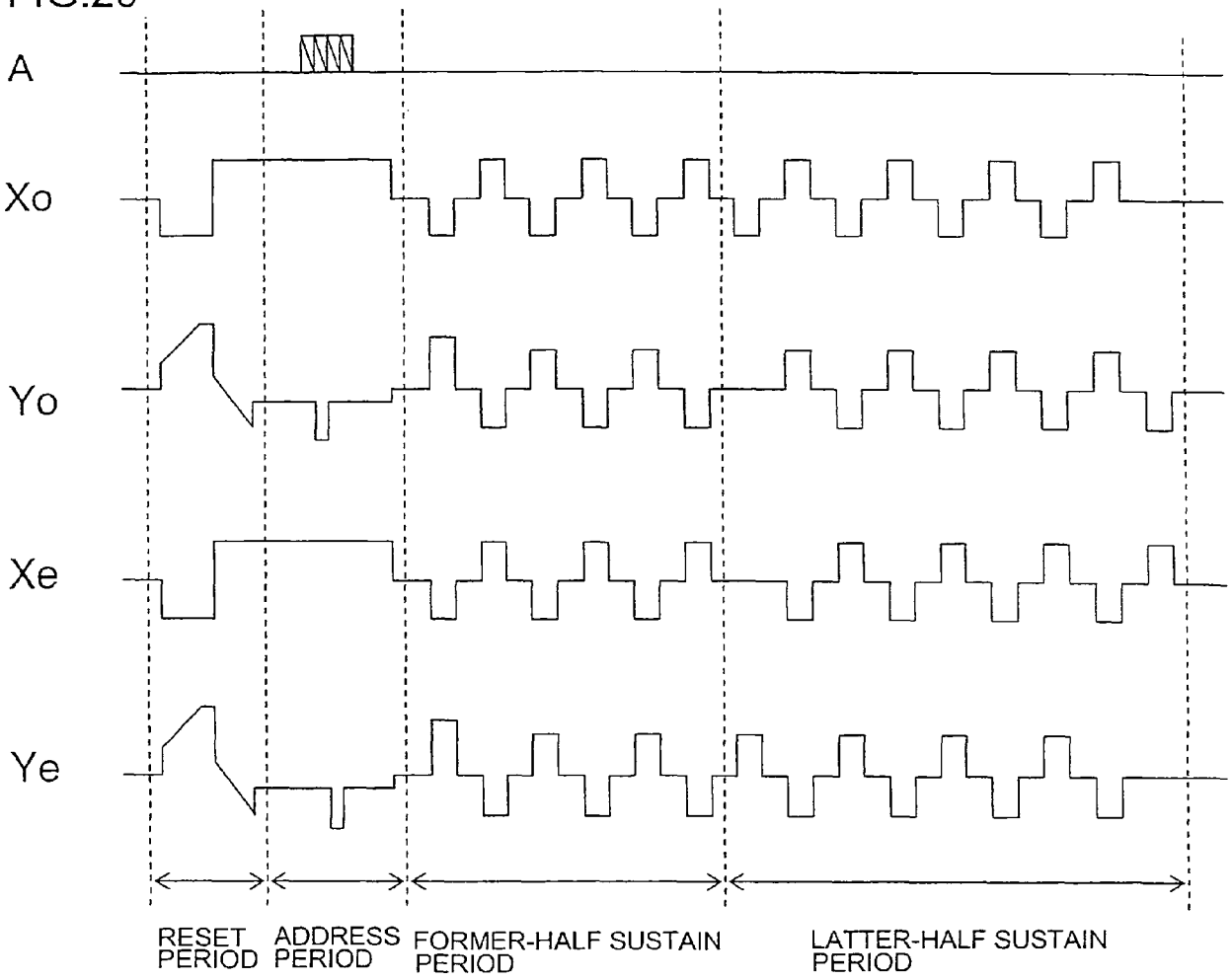
FIG. 20 is a diagram illustrating driving waveforms (even field) in the second embodiment.
Figure 21:
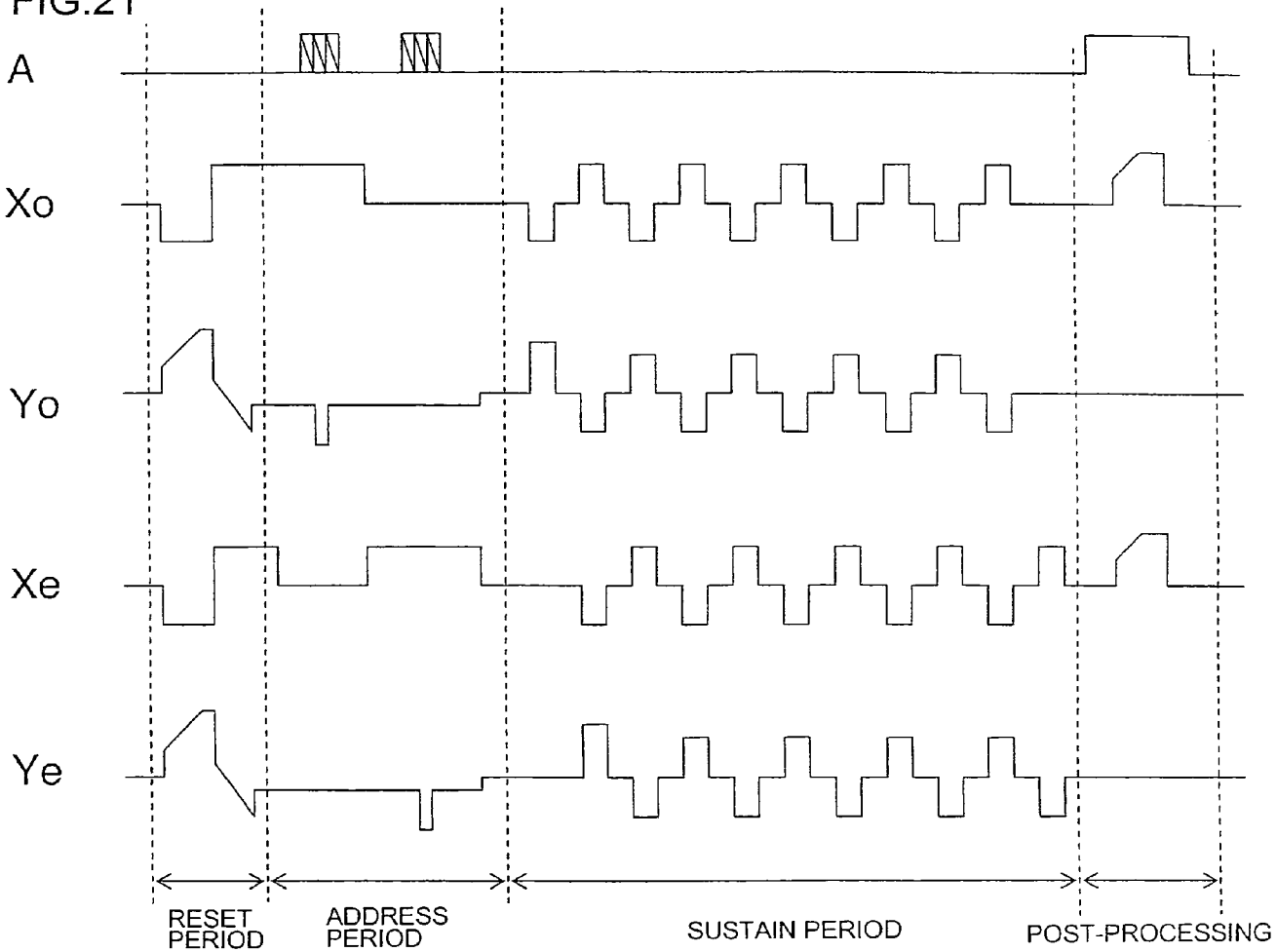
FIG. 21 is a diagram illustrating driving waveforms (in the case of $\alpha=0$; odd field) in the second embodiment.
Figure 22:
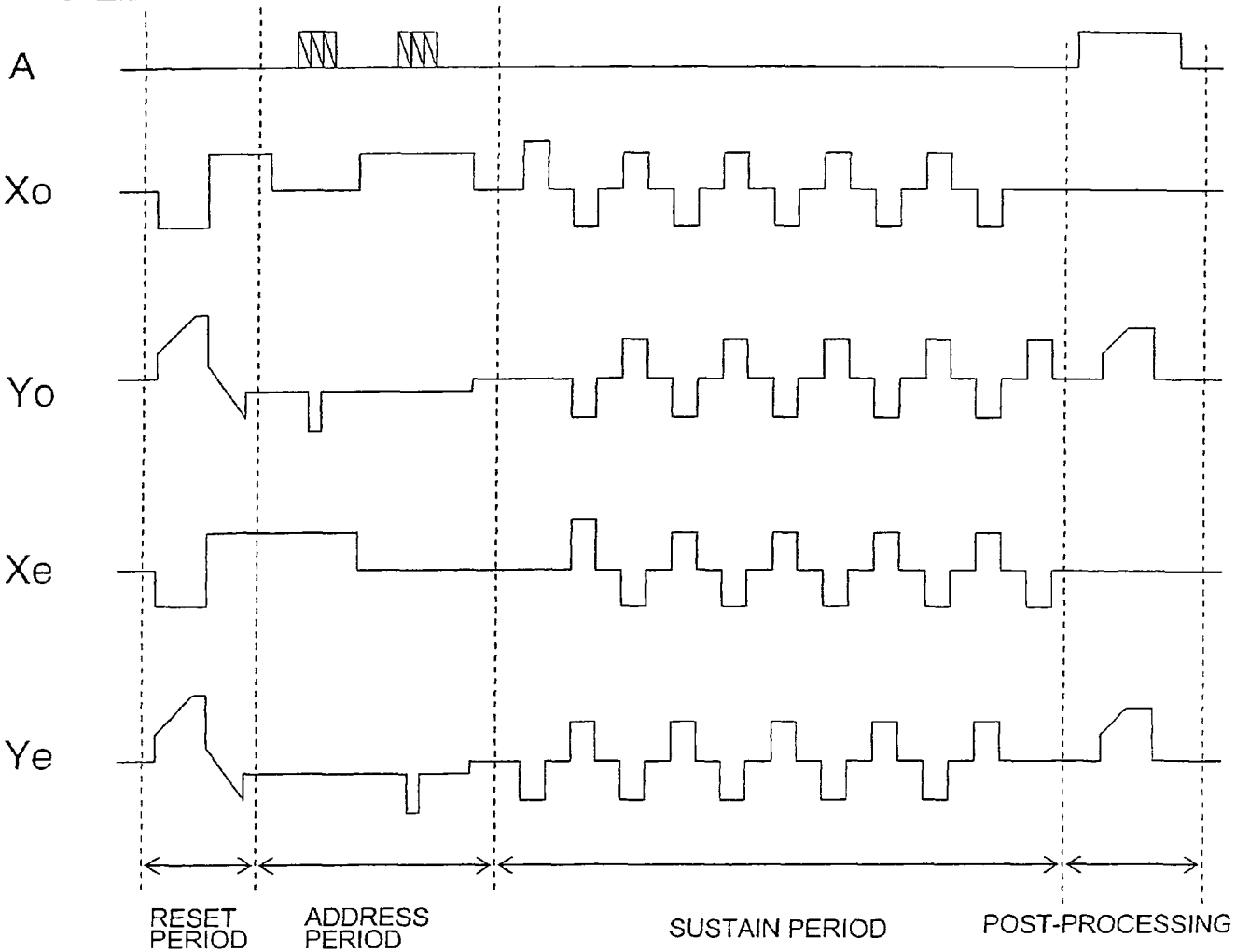
FIG. 22 is a diagram illustrating driving waveforms (in the case of $\alpha=0$; even field) in the second embodiment.

FIG. 17 shows the whole configuration of the driving of the second embodiment, and FIG. 18 shows the driving circuit. The driving waveforms in this case are shown in FIGS. 19 to 22. The driving circuit is configured by an address electrode driving circuit 2, a scanning electrode driving circuit 3, a sustain electrode driving circuit 4, a control circuit 5, and the like. In the second embodiment, only one system is provided as the scanning electrode circuit, and the circuit configuration is simplified. However, the resolution deteriorates. Since a pair of two lines is fixed in this embodiment, a part to which the two-line lighting is applied is shown as a progressive image for which the number of lines is halved. Theoretically, the image components can express only space frequencies up to ¼p. The components of the image to which the one-line lighting is applied enables interlace display with the ordinary number of lines and is capable of displaying higher frequency components.

Which should be selected between the embodiments 1 and 2 is a designing subject of which should be regarded as more important between simplification of the circuit and the resolution.

Third Embodiment

A third embodiment will be described. When the lighting method of the second embodiment is seen from a different viewpoint, data is displayed at the light emission centroid of two cells combined as a pair. Therefore, if the embodiment 2 is not adjusted, the position of input data and the display position are displaced from each other. In order adjust the displacement, data at the display position is determined by performing interpolation from the input data, and the data is displayed.

In the third embodiment, data displayed in each field is shown at the position of the main line. When this data is denoted by D(n) and input data is denoted by I(n), the following formulas are obtained:

[Formula 6]

$$D(2n+1) = \frac{2+\alpha}{2(1+\alpha)} I(2n+1) + \frac{\alpha}{2(1+\alpha)} I(2n+3) : \text{odd field} \tag{6}$$

[Formula 7]

$$D(2n+2) = \frac{\alpha}{2(1+\alpha)} I(2n) + \frac{2+\alpha}{2(1+\alpha)} I(2n+2) : \text{even field} \tag{7}$$

Figure 23:
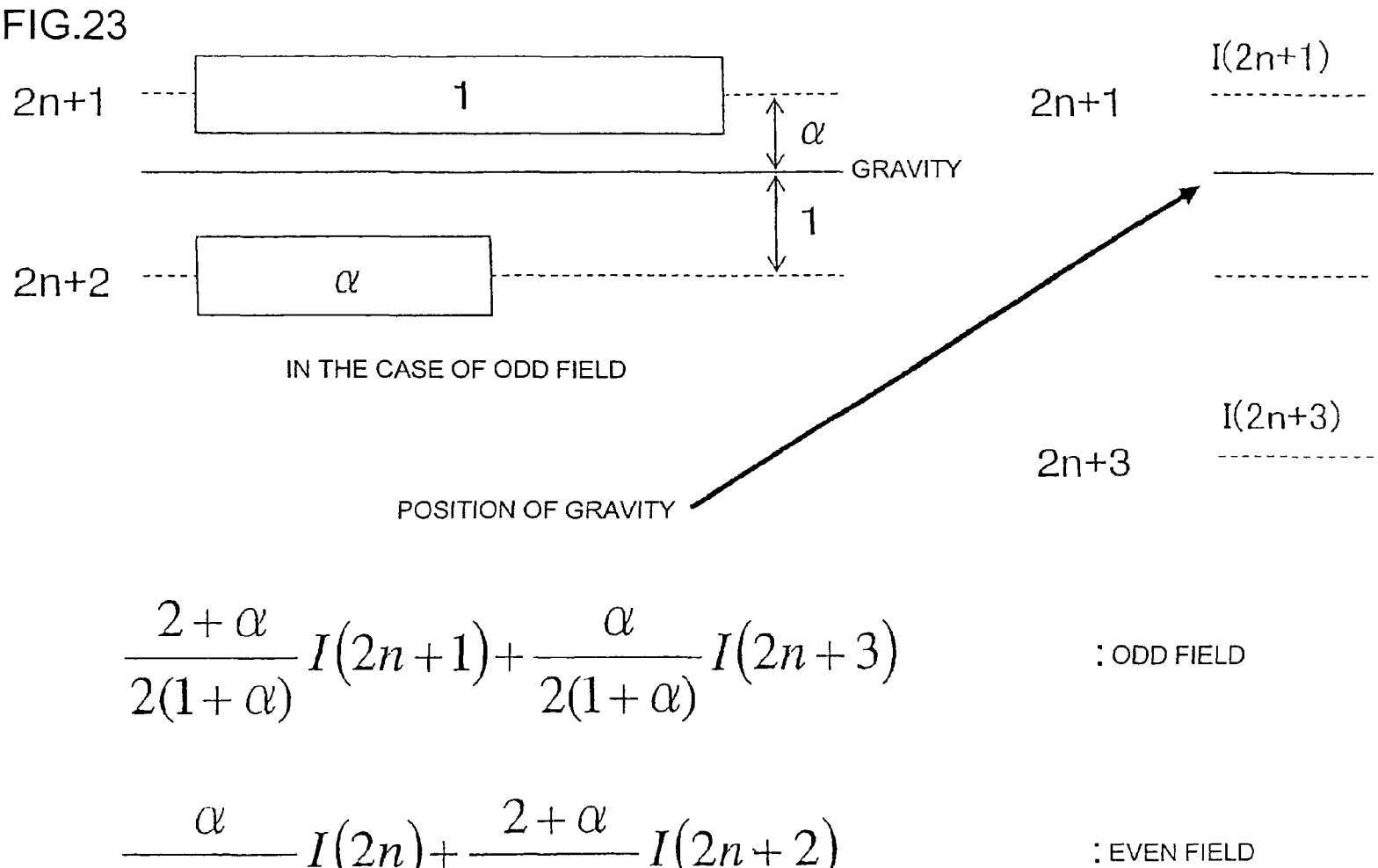
FIG. 23 is a diagram illustrating a display method in a third embodiment.

(see FIG. 23).

The formulas (6) and (7) are applied when the input signal is an interlace signal. When the signal is a progressive signal with the same number of lines (in the case of a 1080 p signal for a panel with 1080 lines), more accurate adjustment can be performed. Commonly, an inputted progressive signal is thinned and converted to an interlace signal, and then it is displayed. However, the data is adjusted in accordance with the formula as shown below, without thinning out the signal.

[Formula 8]

$$D(2n+1) = \frac{1}{1+\alpha} I(2n+1) + \frac{\alpha}{1+\alpha} I(2n+2) : \text{odd field} \tag{8}$$

[Formula 9]

$$D(2n+2) = \frac{\alpha}{1+\alpha} I(2n+1) + \frac{1}{1+\alpha} I(2n+2) : \text{even field} \tag{9}$$

In the case where the two-line lighting rate differs according to subframes, the weighted average value (the gravity position) of the two-line lighting rates of all the subframes is used in the above calculation. The weight used then is the luminance weight of each subframe.

Fourth Embodiment

A fourth embodiment will be described. In the case of an ordinary picture signal, the amplitude of a high-frequency component is small. A component with a small amplitude is expressed by a lower-order SF the luminance weight of which is small. Therefore, by using a method in which the two-line lighting ratio is set relatively low for a lower-order SF and relatively high for a higher-order SF, it is possible to improve the luminance without suppressing the substantial resolution much.

Figure 24:
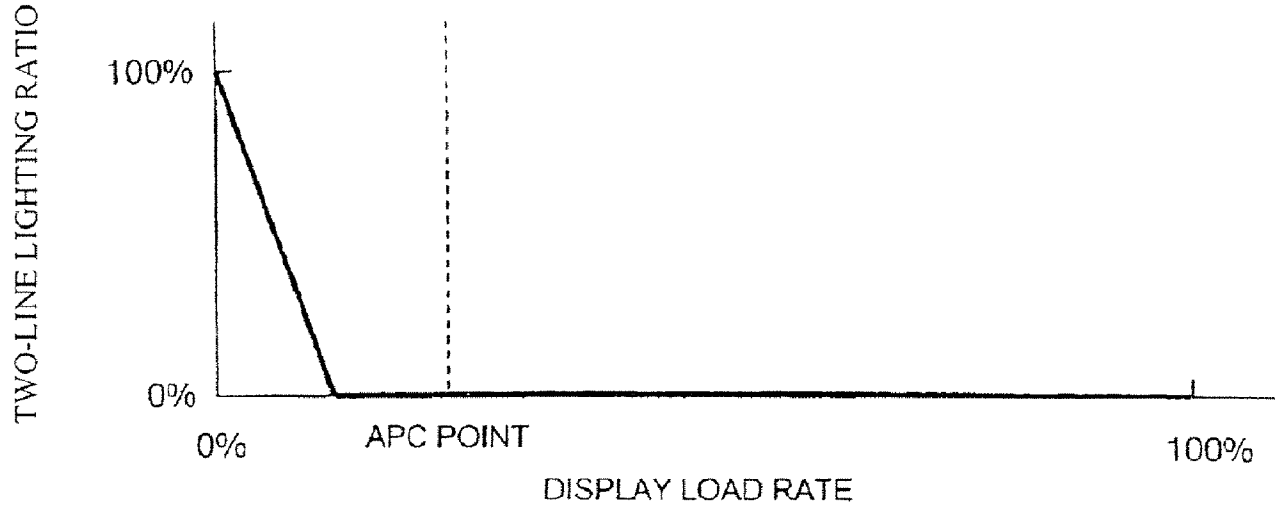
FIG. 24 is a diagram illustrating a two-line lighting rate control method in a fourth embodiment.
Figure 24:
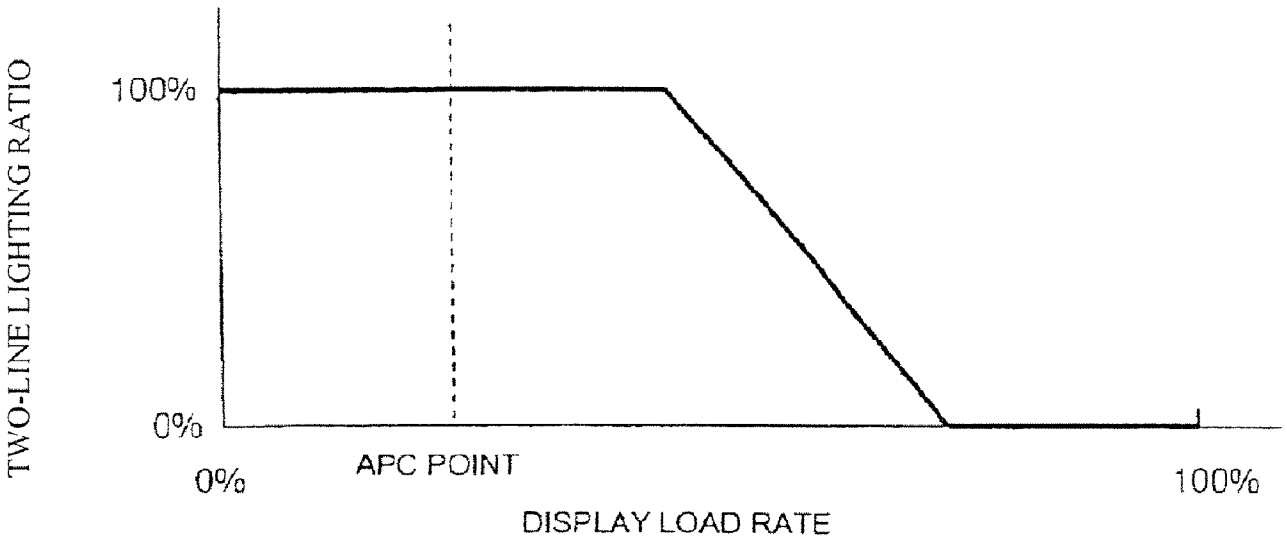

Specifically, as shown in FIG. 24, the two-line lighting ratio relative to the display load rate is set relatively low for a lower-order SF (FIG. 24(*a*)) and relatively high for a higher-order SF (FIG. 24(*b*)).

Fifth Embodiment

Figure 25:
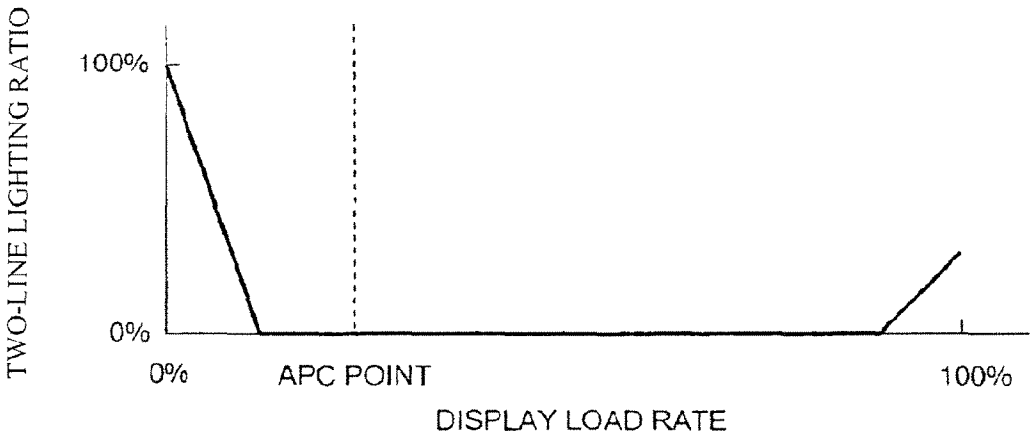
FIG. 25 is a diagram illustrating a control method in a sixth embodiment.
Figure 25:
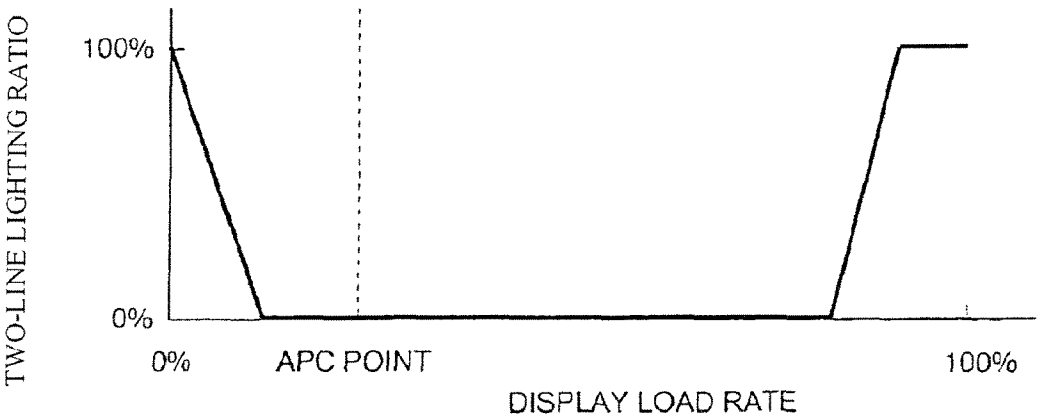

A fifth embodiment will be described. In the above embodiments, the two-line lighting ratio is increased as the display load rate decreases. However, in areas with a load rate close to 100%, the whole screen is almost only in white. Therefore, the resolution is not required to be so high in the areas also, and the two-line lighting ratio may be set high (see FIG. 25*a*). Furthermore, when the load rate is larger than a certain predetermined value, the two-line lighting ratio may be set at 100% (see FIG. 25*b*). When the display load rate is near 0% or a predetermined value or less, the two-line lighting ratio is not required to be set at 100%. For example, it is possible to set it at 80% or more.

Sixth Embodiment

A sixth embodiment will be described. Whether the resolution should be regarded as important or the luminance should be regarded as important depends on the user's taste. Therefore, as for the settings for the two-line lighting ratio, it is preferable to prepare multiple menus to enable the user of a plasma display device with a plasma display module incorporated to make settings himself. For example, the user is enabled to set the luminance high (set the two-line lighting ratio high) for an ordinary TV program and set the resolution high (set the two-line lighting ratio low, and fix the one-line lighting for all the SFs in an extreme case) for movie appreciation. It is not necessary to set the two-line lighting ratio at 100% where the display load rate is near 0%, and it is possible to set it, for example, at 80% or more.

Seventh Embodiment

A seventh embodiment will be described. When the two-line lighting rate is fixed as 100% for all the SFs, this panel becomes a progressive panel with half the number of horizontal lines. For example, if the number of lines is 1080, it becomes a 540 p panel. Therefore, it is preferable to perform 540 p progressive display for a 540 p picture source.

Data to be displayed in each field is shown at the position of the main line. When this data is denoted by D(n) and input data is denoted by I(n), the following formulas are obtained:

[Formula 10]

$$D(2n+1)=I(n)\text{:odd field} \tag{10}$$

[Formula 11]

$$D(2n+2)=I(n)\text{:even field} \tag{11}$$

Whether or not to perform progressive display may be selected by the user of the plasma display device or may be automatically judged from a signal.

INDUSTRIAL APPLICABILITY

It is possible to improve the luminance while suppressing deterioration of the resolution of a plasma display module or a plasma display device, and thereby perform image display having a good balance between the resolution and the luminance.

The invention claimed is:

1. A plasma display module comprising:

a panel section;

an interlace signal processing means configured by an odd field and an even field;

a driving section which divides one field period into multiple subframes and drives two vertically adjacent cells of the panel section as a pair by a signal corresponding to one horizontal scanning line of an interlace signal; and a means for detecting a display load rate of the panel section, wherein:

the driving section drives the two cells in a manner that one of light emission intensities of the two cells differs from another, in at least one subframe of the multiple subframes, the driving section drives in a manner that two-line lighting ratio α, which is a ratio of light emission intensity of a first cell being a small light emission intensity of the two cells to light emission intensity of a second cell being larger light emission intensity, is changed in accordance with the display load rate, and a two-line lighting ratio α1 at a first display load rate within a predetermined range of the display load rate satisfies the following formula with respect to two-line lighting ratio α2 at a second display load rate, the second display load rate being larger than the first display load rate:

$$0<\alpha 2<\alpha 1<1.$$

2. The plasma display module according to claim 1, wherein the interlace signal processing means is configured to include means for converting a progressive signal to the interlace signal.

3. The plasma display module according to claim 1, wherein:

the second cell is contained in an odd line at the odd field and in an even line at the even field, and the first cell is disposed under the second cell in both fields.

4. The plasma display module according to claim 1, wherein:

the second cell is contained in an odd line at the odd field and in an even line at the even field, and the first cell is disposed under the second cell in the odd field and over the second cell in the even field.

5. The plasma display module according to claim 1, wherein the driving section performs control so that, when the display load rate is near 0%, the two-line lighting ratio α comes nearer to 1 as the display load rate decreases.

6. The plasma display module according to claim 1, wherein the display load rate within the predetermined range is a display load rate of low load rate side, the driving section performs control so that, when the display load rate of high load rate side is near 100%, the two-line lighting ratio α comes nearer to 1 as the display load rate increases.

7. The plasma display module according to claim 1, characterized in being configured to perform control so that light is extinguished for one of the two cells when the display load rate is a predetermined value or more.

8. The plasma display module according to claim 1, wherein:

there are multiple subframes which change the two-line lighting ratio α in accordance with the display load rate, and all the two-line lighting ratio α of the respective multiple subframes are substantially constant.

9. The plasma display module according to claim 1, wherein the two-line lighting ratio α of the respective multiple subframes between the two cells is higher in the subframe weighted much than in the subframe weighted less.

10. The plasma display module according to claim 7, characterized in being configured so that it is possible to set a value of the display load rate which causes the light for one of the two cells to be extinguished.

11. The plasma display module according to claim 1, characterized in that each of the multiple subframes is formed to have a display discharge period, and display discharge is simultaneously performed in the two cells during the display discharge period of at least one subframe.

12. The plasma display module according to claim 11, wherein all ratios of number of sustain discharges of the two cells during the display discharge periods of the respective multiple subframes are substantially constant.

13. The plasma display module according to claim 1, wherein each of the multiple subframes has a display discharge period, and the ratios of number of sustain discharges of the two cells during the display discharge period of each of the multiple subframes is controlled on the basis of the display load rate.

14. The plasma display module according to claim 1, wherein the driving section calculates the image data at the light emission centroid position of the two cells on the basis of input data from the processing means and the two-line lighting ratio α for each of the multiple subframes, and performs driving with the image data.

15. A method for driving a plasma display module comprising a panel section, an interlace signal processing means configured by an odd field and an even field and a means for detecting a display load rate of the panel section, the method comprising:

dividing one field period into multiple subframes; and driving two vertically adjacent cells of the panel section as a pair on the basis of a signal corresponding to one horizontal scanning line of the interlace signal, in a manner that the light emission intensities of the two cells differ from each other;

driving in a manner that two-line lighting ratio α, which is a ratio of light emission intensity of a first cell being a small light emission intensity of the two cells to light emission intensity of a second cell being larger light emission intensity is changed in accordance with the display load rate, in at least one subframe among the multiple subframes, and a two-line lighting ratio α1 at a first display load rate within a predetermined range of the display load rate satisfies the following formula with respect to two-line lighting ratio α2 at a second display load rate, the second display load rate being larger than the first display load rate:

$$0<\alpha 2<\alpha 1<1.$$

16. The plasma display module driving method according to claim 15, characterized in that the processing means is configured to include means for converting a progressive signal to the interlace signal, and driving is possible for any input signal of the progressive signal and the interlace signal.

17. A plasma display apparatus comprising:

a panel section;

an interlace signal processing means configured by an odd field and an even field;

a driving section which divides one field period into multiple subframes and drives two vertically adjacent cells of the panel section as a pair by a signal corresponding to one horizontal scanning line of the interlace signal;

a means for detecting a display load rate of the panel section; and a selection control means for selecting one of multiple two-line lighting ratios α, wherein:

driving the two cells in a manner that the light emission intensities of the two cells are changed with respect to each other, in at least one subframe among the multiple subframes, on the basis of the display load rate and a two-line lighting ratio α1 at a first display load rate within a predetermined range of the display load rate satisfies the following formula with respect to two-line lighting ratio α2 at a second display load rate, the second display load rate being larger than the first display load rate:

$$0<\alpha 2<\alpha 1<1.$$

18. The plasma display apparatus according to claim 17, wherein the interlace signal processing means is configured to include means for converting a progressive signal to the interlace signal, and driving is possible for any input signal of the progressive signal and the interlace signal.

* * * * *